US012220025B2

(12) United States Patent
Karmakar

(10) Patent No.: US 12,220,025 B2
(45) Date of Patent: Feb. 11, 2025

(54) ZIPPER PULL TAB ATTACHMENT FOR PROVIDING AN ENLARGED GRIPPING SURFACE TO A ZIPPER PULL TAB

(71) Applicant: Srimonti Karmakar, Toronto (CA)

(72) Inventor: Srimonti Karmakar, Toronto (CA)

( * ) Notice: Subject to any disclaimer, the term of this patent is extended or adjusted under 35 U.S.C. 154(b) by 248 days.

(21) Appl. No.: 17/979,185

(22) Filed: Nov. 2, 2022

(65) Prior Publication Data

US 2023/0135664 A1 May 4, 2023

Related U.S. Application Data

(60) Provisional application No. 63/275,007, filed on Nov. 3, 2021.

(51) Int. Cl.
*A44B 19/26* (2006.01)

(52) U.S. Cl.
CPC ..... *A44B 19/262* (2013.01)

(58) Field of Classification Search
CPC ..... A44B 19/262; Y10T 24/2586
See application file for complete search history.

(56) References Cited

U.S. PATENT DOCUMENTS 4,193,172 A 3/1980 Kanzaka
4,389,758 A 6/1983 Akashi
4,873,750 A 10/1989 Tracy
5,090,096 A * 2/1992 Terada ..... A44B 19/262 24/429
7,117,567 B1 10/2006 Krulik et al.
8,234,760 B2 * 8/2012 Vogelsang ..... A44B 19/262 24/429
8,453,301 B1 6/2013 McCoy
8,677,574 B1 3/2014 Thiessen et al.
(Continued)

FOREIGN PATENT DOCUMENTS

WO 2006116409 A2 11/2006

OTHER PUBLICATIONS

Zip-Grip Zipper Pull—Pack of 6, Amazon.com, https://www.amazon.com/Zip-Grip-Zipper-Pull-Pack-6/dp/B002L0IUMM.
(Continued)

*Primary Examiner* — Jason W San
*Assistant Examiner* — Louis A Mercado
(74) *Attorney, Agent, or Firm* — Dhiraj Jindal; PATENT YOGI LLC

(57) ABSTRACT

A zipper pull tab attachment for providing an enlarged gripping surface to a zipper pull tab. Further, the zipper pull tab attachment may include a top component and a bottom component. Further, the top component may include a top fastening component. Further, the bottom component may be configured to be removably attached to at least a portion of the top component. Further, the top component and the bottom component form an interior space when attached together. Further, the interior space may be configured for encasing at least a part of the zipper pull tab. Further, the bottom component may include a bottom fastening component. Further, the top fastening component may be configured to mate with the bottom fastening component. Further, the bottom component may include a protrusion. Further, the protrusion may be configured to pass through an opening of the zipper pull tab.

12 Claims, 30 Drawing Sheets

(56) References Cited

U.S. PATENT DOCUMENTS

| | | | | |
|---|---|---|---|---|
| 9,545,158 | B2 * | 1/2017 | Goldberg | A47C 31/105 |
| 10,905,204 | B2 * | 2/2021 | Kondo | A44B 19/262 |
| 11,395,529 | B2 * | 7/2022 | Hsu | A44B 19/26 |
| 2006/0242804 | A1 | 11/2006 | Griffiths | |
| 2006/0290497 | A1 * | 12/2006 | Sugata | A44B 1/08 340/572.1 |
| 2012/0284971 | A1 | 11/2012 | Roberts | |
| 2014/0082895 | A1 * | 3/2014 | Gold | A44B 19/26 24/415 |
| 2023/0135664 | A1 * | 5/2023 | Karmakar | A44B 19/262 24/429 |

OTHER PUBLICATIONS

Zpsolution Zipper Pull Tab Replacement Metal Zipper Handle Mend Fixer for Suitcases Luggage Jacket Backpacks Coat Boots, Amazon.com, https://www.amazon.com/Zpsolution-Replacement-Suitcases-Luggage-Backpacks/dp/B07VQK4D34?th=1.

Zipper Pull Tabs for Arthritis | Weak Grip Dressing Aid for The Disabled | Cold Weather Sport Gear (10 Pack), NineLife Europe, https://www.ninelife.fi/products/zipper-pull-tabs-for-arthritis-weak-grip-dressing-aid-for-the-disabled-cold-weather-sport-gear-10-pack.

Zip-Grip Zipper Pull, North Coast Medical Inc., https://www.ncmedical.com/products/zip-grip-zipper-pull_299.html.

Zipper Pulls, Gear Aid Inc., https://www.gearaid.com/products/replace-zipper-pulls?variant=32484629053537.

* cited by examiner

ZIPPER PULL TAB ATTACHMENT FOR PROVIDING AN ENLARGED GRIPPING SURFACE TO A ZIPPER PULL TAB

CROSS-REFERENCE TO RELATED APPLICATIONS

This application claims the benefit of U.S. Provisional Application No. 63/275,007, filed on 3 Nov. 2021, the contents of which are hereby incorporated by reference.

FIELD OF THE INVENTION

Generally, the present disclosure relates to the field of zipper-type closure assemblies. More specifically, the present disclosure relates to a zipper pull tab attachment for providing an enlarged gripping surface to a zipper pull tab.

BACKGROUND OF THE INVENTION

The field of zipper-type closure assemblies is technologically important to several industries, business organizations, and/or individuals.

Typical zipper pull tabs are designed for operation using dexterity of the thumb and one or more fingers in order to "precision grip" the pull tab by pressing the intermediate and distal phalanges of a finger (or fingers) and the thumb against each other. Zipper pull tabs are usually too short, narrow, and/or thin to "power grip" by wrapping all fingers and possibly the palm of a hand around the pull tab. Toddlers and preschool children usually lack the fine motor skills needed to precision grip a pull tab securely. Additionally, older children or adults may lack the finger apparatus or sufficient dexterity, stability, or strength in their fingers to precision grip a pull tab. While some existing zipper pull tabs exist in the form of cords or rings attached to pull tabs to facilitate their operation, for those lacking the ability to precision grip, a larger and more rounded pull tab that can be comfortably gripped by wrapping several fingers and/or the palm of a hand around it would enable easier operation.

Therefore, there is a need for improved zipper pull tab attachment that may overcome one or more of the above-mentioned problems and/or limitations.

SUMMARY OF THE INVENTION

This summary is provided to introduce a selection of concepts in a simplified form, that are further described below in the Detailed Description. This summary is not intended to identify key features or essential features of the claimed subject matter. Nor is this summary intended to be used to limit the claimed subject matter's scope.

The present disclosure may provide a zipper pull tab attachment for providing an enlarged gripping surface to a zipper pull tab. Further, the zipper pull tab attachment may include a top component comprising one or more top fastening components. Further, the zipper pull tab attachment may include a bottom component which may be configured to be removably attached to at least a portion of the top component. Further, the top component and the bottom component form an interior space when attached together. Further, the interior space may be configured for encasing at least a part of the zipper pull tab. Further, the bottom component may include one or more bottom fastening components. Further, the one or more top fastening components may be configured to mate with the one or more bottom fastening components. Further, the bottom component may include one or more protrusions. Further, the one or more protrusions may be configured to pass through one or more openings of the zipper pull tab.

The present disclosure may provide a zipper pull tab attachment for providing an enlarged gripping surface to a zipper pull tab. Further, the zipper pull tab attachment may include a top component comprising one or more top fastening components. Further, the one or more top fastening components may comprise a channel region. Further, the channel region may be configured for mating with one or more protrusions. Further, the zipper pull tab attachment may include a bottom component which may be configured to be removably attached to at least a portion of the top component. Further, the bottom component may include a bottom outer surface and a bottom inner surface opposing the bottom outer surface. Further, the bottom outer surface is characterized by a bottom curvature. Further, the bottom curvature may enlarge a gripping surface of the bottom outer surface. Further, the top component and the bottom component form an interior space when attached together. Further, the interior space may be configured for encasing at least a part of the zipper pull tab. Further, the bottom component may include one or more bottom fastening components. Further, the one or more top fastening components may be configured to mate with the one or more bottom fastening components. Further, the bottom component may include the one or more protrusions. Further, the one or more protrusions may be configured to pass through one or more openings of the zipper pull tab. Further, the one or more openings may comprise a proximal opening disposed on a proximal portion of the zipper pull tab. Further, the proximal portion is adjacent to a slider bridge of a zipper slider. Further, the one or more openings may comprise a distal opening disposed on a distal portion of the zipper pull tab. Further, the one or more protrusions may be configured to pass through the proximal opening.

The present disclosure may provide a zipper pull tab attachment for providing an enlarged gripping surface to a zipper pull tab. Further, the zipper pull tab attachment may include a top component comprising one or more top fastening components. Further, the one or more top fastening components may comprise a channel region. Further, the channel region may be configured for mating with one or more protrusions. Further, the zipper pull tab attachment may include a bottom component which may be configured to be removably attached to at least a portion of the top component. Further, the bottom component may include a bottom outer surface and a bottom inner surface opposing the bottom outer surface. Further, the bottom outer surface is characterized by a bottom curvature. Further, the bottom curvature may enlarge a gripping surface of the bottom outer surface. Further, the top component may include a top outer surface and a top inner surface opposing the top outer surface. Further, the top outer surface is characterized by a top curvature. Further, the top curvature may enlarge a gripping surface of the top outer surface. Further, the top component and the bottom component form an interior space when attached together. Further, the interior space may be configured for encasing at least a part of the zipper pull tab. Further, the bottom component may include one or more bottom fastening components. Further, the one or more top fastening components may be configured to mate with the one or more bottom fastening components. Further, the bottom component may include the one or more protrusions. Further, the one or more protrusions may be configured to pass through one or more openings of the zipper pull tab. Further, the one or more openings may comprise a proximal opening disposed on a proximal portion of the zipper pull tab. Further, the proximal portion is adjacent to a slider bridge of a zipper slider. Further, the one or more openings may comprise a distal opening disposed on a distal portion of the zipper pull tab. Further, the one or more protrusions may be configured to pass through the proximal opening.

Both the foregoing summary and the following detailed description provide examples and are explanatory only. Accordingly, the foregoing summary and the following detailed description should not be considered to be restrictive. Further, features or variations may be provided in addition to those set forth herein. For example, embodiments may be directed to various feature combinations and subcombinations described in the detailed description.

BRIEF DESCRIPTION OF THE DRAWINGS

The accompanying drawings, which are incorporated in and constitute a part of this disclosure, illustrate various embodiments of the present disclosure. The drawings contain representations of various trademarks and copyrights owned by the Applicants. In addition, the drawings may contain other marks owned by third parties and are being used for illustrative purposes only. All rights to various trademarks and copyrights represented herein, except those belonging to their respective owners, are vested in and the property of the applicants. The applicants retain and reserve all rights in their trademarks and copyrights included herein, and grant permission to reproduce the material only in connection with reproduction of the granted patent and for no other purpose.

Furthermore, the drawings may contain text or captions that may explain certain embodiments of the present disclosure. This text is included for illustrative, non-limiting, explanatory purposes of certain embodiments detailed in the present disclosure.

DETAIL DESCRIPTIONS OF THE INVENTION

Figure 1:
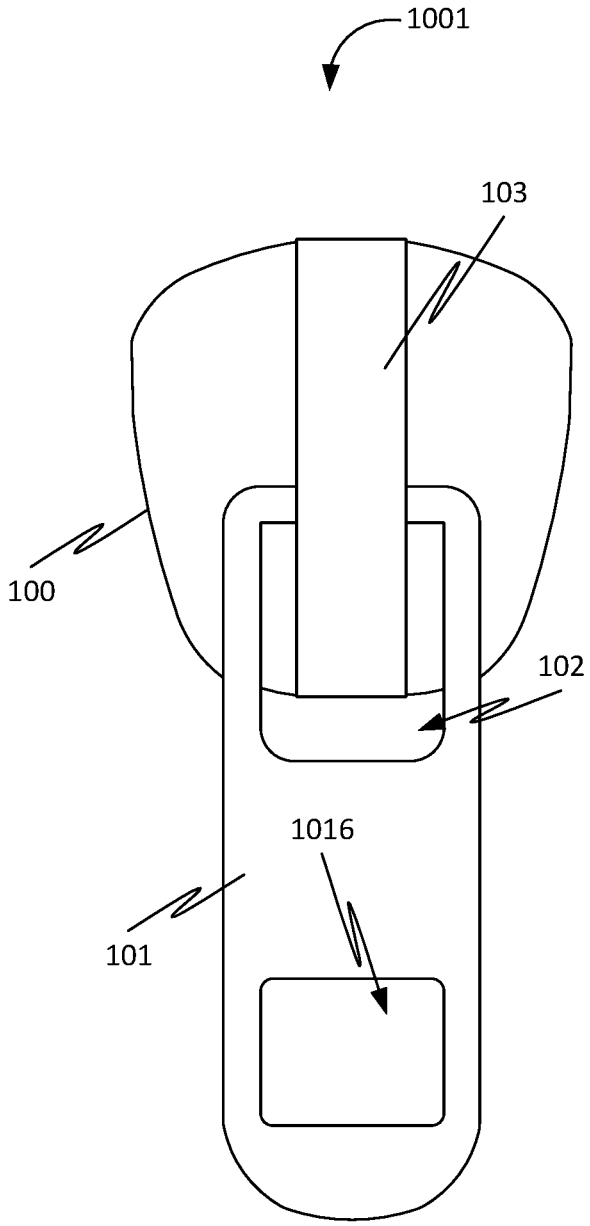
FIG. 1 is a top view of a conventional zipper slider and pull tab assembly 1001, in accordance with prior art.

As a preliminary matter, it will readily be understood by one having ordinary skill in the relevant art that the present disclosure has broad utility and application. As should be understood, any embodiment may incorporate only one or a plurality of the above-disclosed aspects of the disclosure and may further incorporate only one or a plurality of the above-disclosed features. Furthermore, any embodiment discussed and identified as being "preferred" is considered to be part of a best mode contemplated for carrying out the embodiments of the present disclosure. Other embodiments also may be discussed for additional illustrative purposes in providing a full and enabling disclosure. Moreover, many embodiments, such as adaptations, variations, modifications, and equivalent arrangements, will be implicitly disclosed by the embodiments described herein and fall within the scope of the present disclosure.

Accordingly, while embodiments are described herein in detail in relation to one or more embodiments, it is to be understood that this disclosure is illustrative and exemplary of the present disclosure, and are made merely for the purposes of providing a full and enabling disclosure. The detailed disclosure herein of one or more embodiments is not intended, nor is to be construed, to limit the scope of patent protection afforded in any claim of a patent issuing here from, which scope is to be defined by the claims and the equivalents thereof. It is not intended that the scope of patent protection be defined by reading into any claim limitation found herein and/or issuing here from that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present disclosure. Accordingly, it is intended that the scope of patent protection is to be defined by the issued claim(s) rather than the description set forth herein.

Additionally, it is important to note that each term used herein refers to that which an ordinary artisan would understand such term to mean based on the contextual use of such term herein. To the extent that the meaning of a term used herein—as understood by the ordinary artisan based on the contextual use of such term—differs in any way from any particular dictionary definition of such term, it is intended that the meaning of the term as understood by the ordinary artisan should prevail.

Furthermore, it is important to note that, as used herein, "a" and "an" each generally denotes "at least one," but does not exclude a plurality unless the contextual use dictates otherwise. When used herein to join a list of items, "or" denotes "at least one of the items," but does not exclude a plurality of items of the list. Finally, when used herein to join a list of items, "and" denotes "all of the items of the list."

The following detailed description refers to the accompanying drawings. Wherever possible, the same reference numbers are used in the drawings and the following description to refer to the same or similar elements. While many embodiments of the disclosure may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the disclosure. Instead, the proper scope of the disclosure is defined by the claims found herein and/or issuing here from. The present disclosure contains headers. It should be understood that these headers are used as references and are not to be construed as limiting upon the subjected matter disclosed under the header.

The present disclosure includes many aspects and features. Moreover, while many aspects and features relate to, and are described in the context of a zipper pull tab attachment for providing an enlarged gripping surface to a zipper pull tab, embodiments of the present disclosure are not limited to use only in this context.

Overview:

The present disclosure describes a zipper pull tab attachment for providing an enlarged gripping surface to a zipper pull tab. Further, the zipper pull tab attachment may be placed around a typical zipper pull tab. Further, the zipper pull tab attachment partially or fully encases the zipper pull tab such that a user cannot directly use the original pull tab to operate a zipper and must grip and pull on the zipper pull tab attachment. Further, the zipper pull tab attachment may include an attachment component that is fitted through the attachment hole of the typical zipper pull tab to secure the zipper pull tab attachment to the zipper pull tab. Further, the attachment component may be fitted through a zipper slider bridge to secure the zipper pull tab attachment to the zipper slider. Once attached to the zipper pull tab, the zipper pull tab attachment may be easily detached, restoring the pull tab and the slider to their original form and condition.

In further embodiments, as shown in FIG. 3-FIG. 30, a zipper pull tab attachment 2000 for providing an enlarged gripping surface to a zipper pull tab 101 is disclosed. Accordingly, the zipper pull tab attachment 2000 may include a top component 201 comprising one or more top fastening components 205(*a*) (such as pegs).

Further, the zipper pull tab attachment 2000 may include a bottom component 202 which may be configured to be removably attached to at least a portion of the top component 201. Further, the top component 201 and the bottom component 202 form an interior space 208 (or cavity) when attached together. Further, the interior space 208 may be configured for encasing at least a part of the zipper pull tab (or a pull tab) 101. Further, the bottom component 202 may include one or more bottom fastening components 205(*b*) (such as cavities 205 (*b*)). Further, the one or more top fastening components 205(*a*) may be configured to mate with the one or more bottom fastening components 205(*b*).

Further, the bottom component 202 may include one or more protrusions 204 (or one or more extrusions). Further, the one or more protrusions 204 may be configured to pass through one or more openings 102 (or attachment hole) of the zipper pull tab 101.

Figure 21:
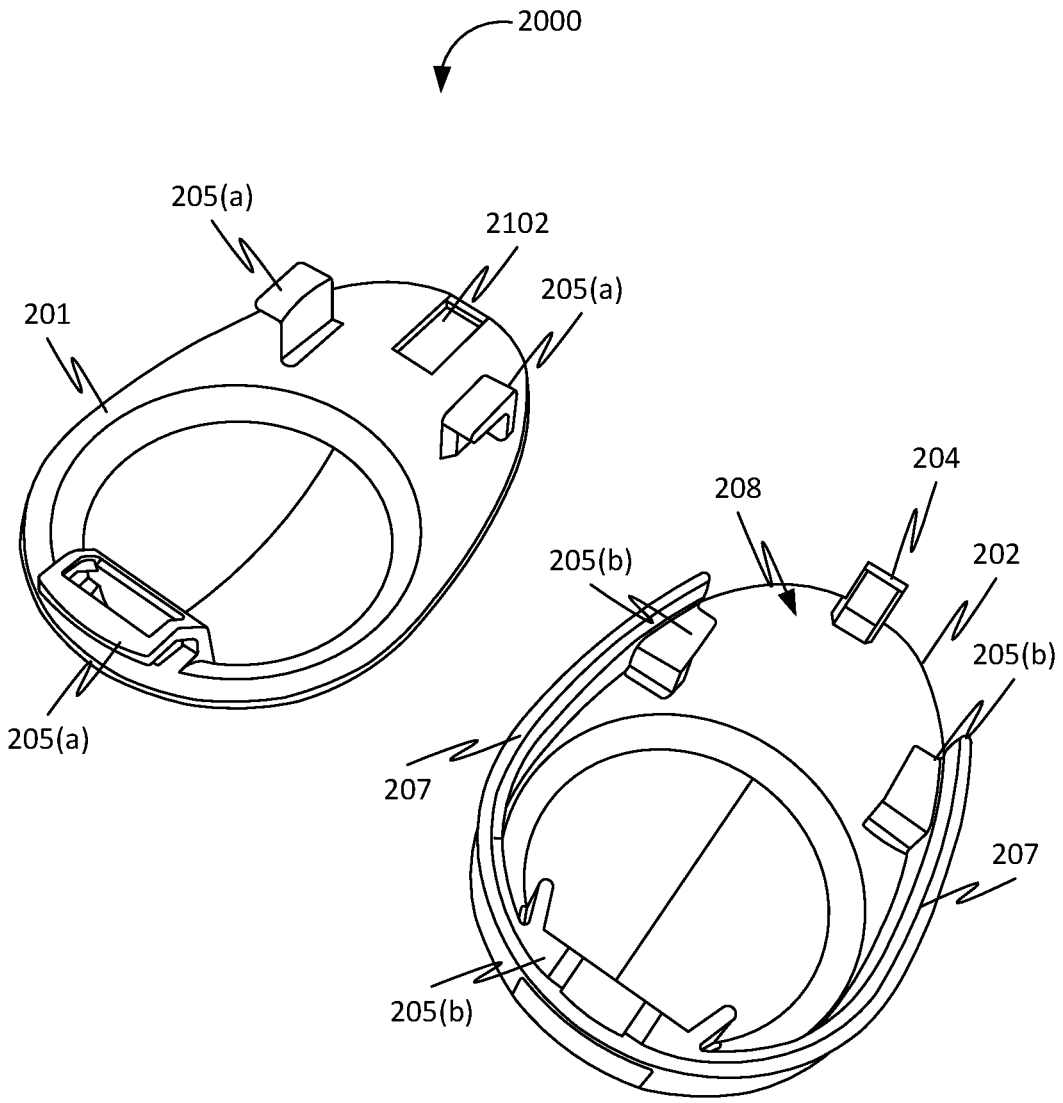
FIG. 21 illustrates the interiors of the top component 201 and the bottom component 202, containing mating snap-fit joints 205(*a*) and 205(*b*), when the top component 201 and the bottom component 202 are not connected, in accordance with some embodiments.

In some embodiments, the one or more top fastening components 205(*a*) may comprise a channel region 2102 (as shown in FIG. 21). Further, the channel region 2102 may be configured for mating with the one or more protrusions 204.

Figure 10:
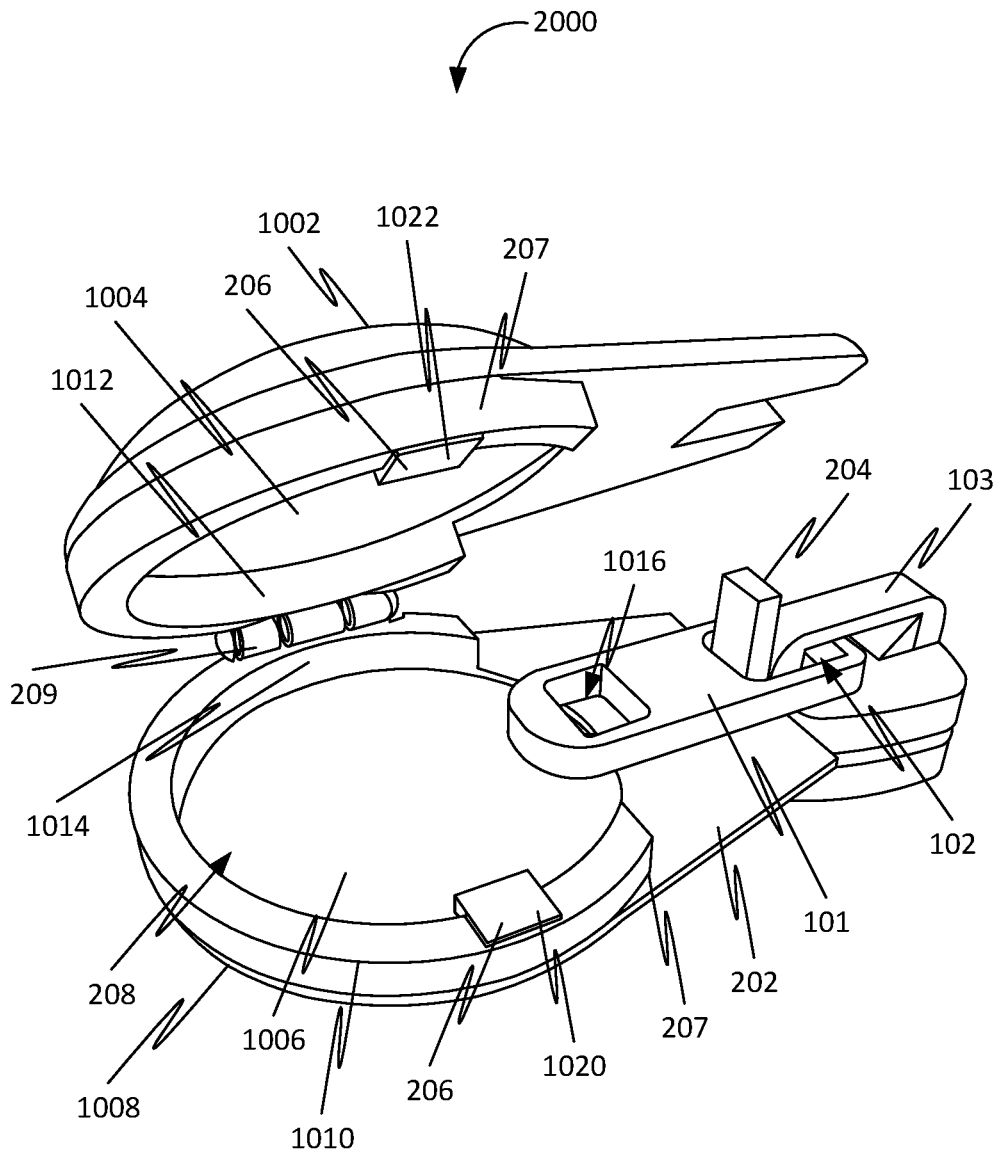
FIG. 10 is a top front right-side perspective view of the zipper pull tab attachment 2000 attached to the zipper pull tab 101, in accordance with some embodiments.

In some embodiments, the top component 201 may comprise a top outer surface 1002 (as shown in FIG. 10) and a top inner surface 1004 (as shown in FIG. 10) opposing the top outer surface 1002. Further, the top outer surface 1002 is characterized by a top curvature. Further, the top curvature may enlarge a gripping surface of the top outer surface 1002.

In some embodiments, the bottom component 202 may comprise a bottom outer surface 1008 (as shown in FIG. 10) and a bottom inner surface 1006 (as shown in FIG. 10) opposing the bottom outer surface 1008. Further, the bottom outer surface 1008 may be characterized by a bottom curvature. Further, the bottom curvature may enlarge a gripping surface of the bottom outer surface 1008.

In some embodiments, the bottom component 202 may comprise a side barrier 207 disposed along at least a portion of a periphery of the bottom component 202. Further, the side barrier 207 may comprise a contiguous wall 1010 (as shown in FIG. 10) disposed on the bottom inner surface 1006. Further, the contiguous wall 1010 is characterized by a wall height. Further, the side barrier 207 is configured for preventing sliding out of the zipper pull tab 101 from the interior space 208.

More generally, in some embodiments of the zipper pull tab attachment 2000, at least one of the bottom component 202 and the top component 201 may include a side barrier 207 disposed along at least a portion of a periphery of at least one of the bottom component and the top component respectively. Further, the side barrier may include a contiguous wall disposed on at least one of the bottom inner surface 1006 and the top inner surface 1004 respectively. Further, the contiguous wall may be characterized by a wall height. Further the side barrier may be configured for preventing sliding out of the zipper pull tab 101 from the interior space.

In some embodiments, the one or more top fastening components 205(*a*) may comprise a male part 205(*a*) of one or more snap-fit joints 205(*a*)-205(*b*). Further, the one or more bottom fastening components 205(*b*) may comprise a female part 205(*b*) of the one or more snap-fit joints 205(*a*)-205(*b*).

In some embodiments, the one or more top fastening components 205(*a*) may comprise a first magnetic part 1022 (as shown in FIG. 10) of one or more magnetic clasps 206 (or magnetic clasps). Further, the one or more bottom fastening components 205(*b*) may comprise a second magnetic part 1020 (as shown in FIG. 10) of the one or more magnetic clasps 206. Further, each of the first magnetic part 1022 and the second magnetic part 1020 may comprise a ferromagnetic substance.

In some embodiments, the zipper pull tab attachment 2000 may comprise a hinge 209 which may be configured to attach at least a first portion 1012 (as shown in FIG. 10) of the top component 201 with a second portion 1014 (as shown in FIG. 10) of the bottom component 202. Further, the hinge 209 may facilitate pivotal movement of the top component 201 in relation to the bottom component 202.

In some embodiments, each of the top component 201 and the bottom component 202 may comprise a deformable material.

Figure 25:
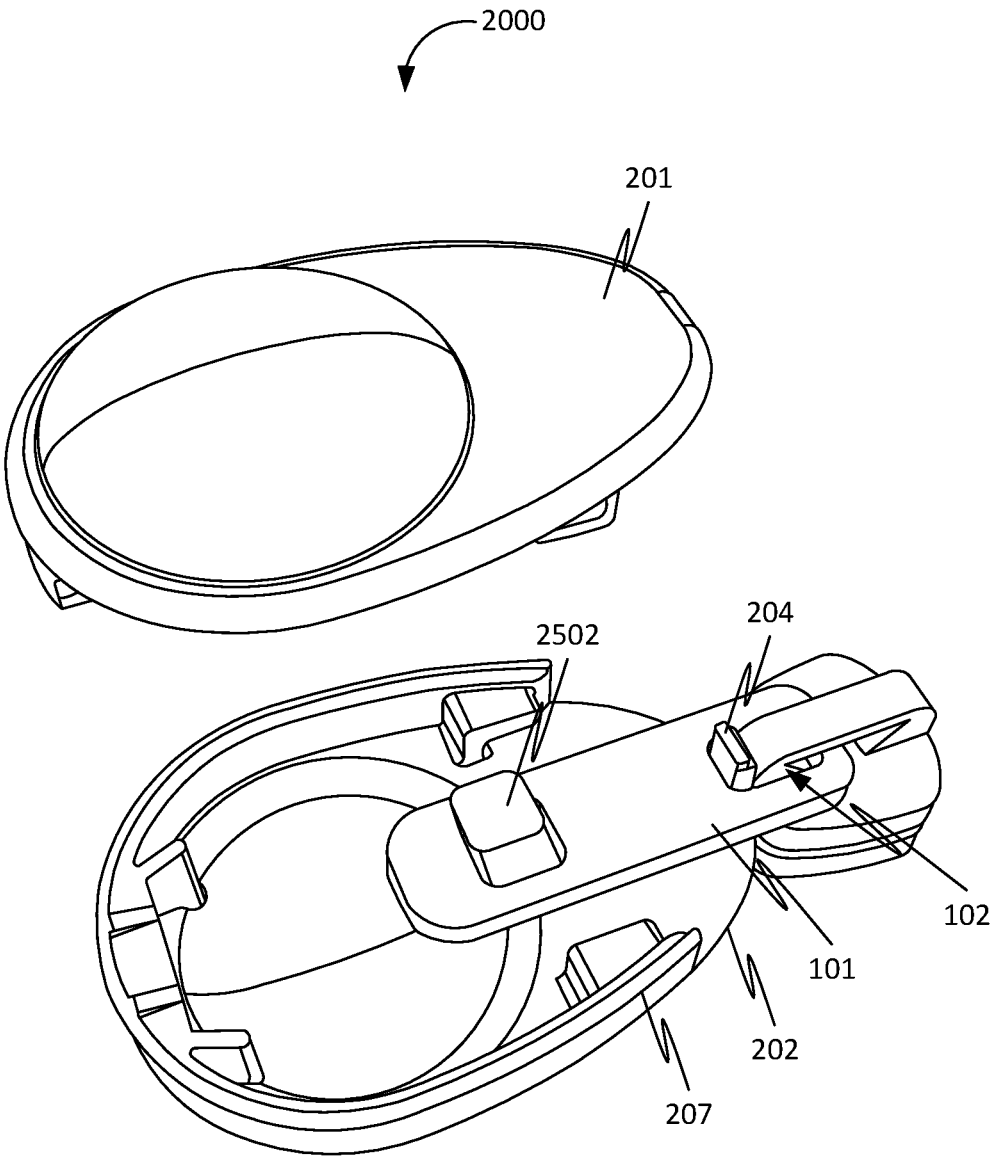
FIG. 25 is an exploded view of the top component 201 and the bottom component 202 of the zipper pull tab attachment 2000 attached to the zipper pull tab 101, in accordance with some embodiments.

In some embodiments, the one or more openings 102 may comprise a proximal opening 102 disposed on a proximal portion of the zipper pull tab 101. Further, the proximal portion is adjacent to a slider bridge 103 of a zipper slider 100. Further, the at least one opening 102 may comprise a distal opening 1016 (as shown in FIG. 10) disposed on a distal portion of the zipper pull tab 101. Further, the one or more protrusions 204 may comprise a proximal protrusion 204 which may be configured to pass through the proximal opening 102 and a distal protrusion 2502 (as shown in FIG. 25) which may be configured to pass through the distal opening 1016.

Figure 26:
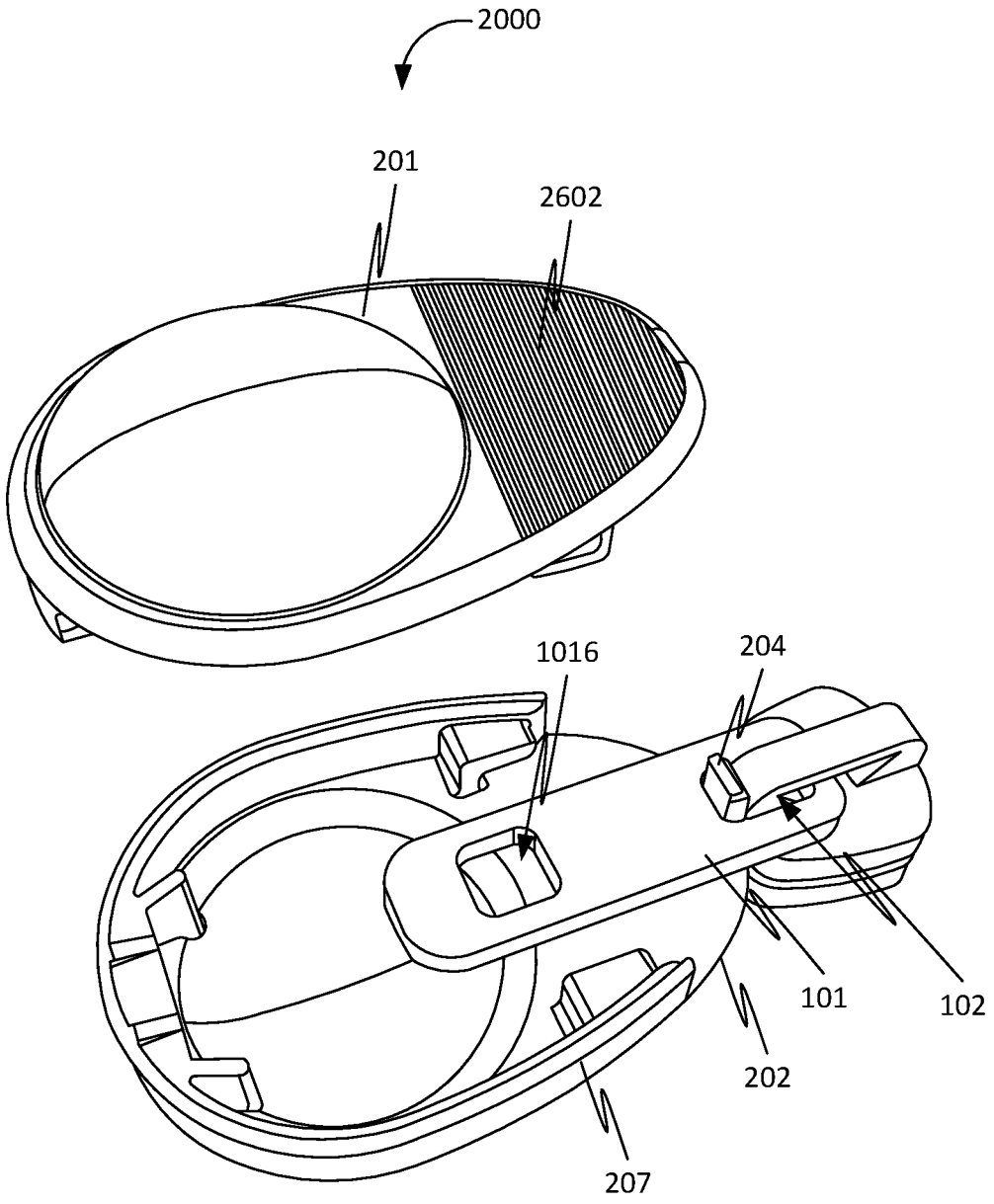
FIG. 26 is an exploded view of the top component 201 and the bottom component 202 of the zipper pull tab attachment 2000 attached to the zipper pull tab 101, in accordance with some embodiments.

In some embodiments, the top component 201 may comprise the top outer surface 1002 and the top inner surface 1004 opposing the top outer surface 1002. Further, the top outer surface 1002 may comprise grooves 2602 (as shown in FIG. 26) to enhance gripping of the zipper pull tab attachment 2000 with a finger.

More generally, in some embodiments of the zipper pull tab attachment 2000, the top component 201 may include a top outer surface 1002 and a top inner surface 1004 opposing the top outer surface. Further, the bottom component may include a bottom outer surface 1008 and a bottom inner surface 1006 opposing the bottom outer surface, Further, at least one of the top outer surface and the bottom outer surface may include at least one of grooves, textured coating and a soft-touch coating may be configured to enhance gripping of the zipper pull tab attachment with a finger.

In further embodiments, the zipper pull tab attachment 2000 for providing an enlarged gripping surface to the zipper pull tab 101 is disclosed.

Further, the zipper pull tab attachment 2000 may include the top component 201 comprising the one or more top fastening components 205(*a*). Further, the one or more top fastening components 205(*a*) may comprise the channel region 2102. Further, the channel region 2102 may be configured for mating with the one or more protrusions 204.

Further, the zipper pull tab attachment 2000 may include the bottom component 202 which may be configured to be removably attached to at least a portion of the top component 201.

Further, the bottom component 202 may include the bottom outer surface 1008 and the bottom inner surface 1006 opposing the bottom outer surface 1008. Further, the bottom outer surface 1008 is characterized by the bottom curvature. Further, the bottom curvature may enlarge a gripping surface of the bottom outer surface 1008. Further, the top component 201 and the bottom component 202 form the interior space 208 when attached together. Further, the interior space 208 may be configured for encasing at least a part of the zipper pull tab 101. Further, the bottom component 202 may include the one or more bottom fastening components 205(*b*). Further, the one or more top fastening components 205(*a*) may be configured to mate with the one or more bottom fastening components 205(*b*).

Further, the bottom component 202 may include the one or more protrusions 204. Further, the one or more protrusions 204 may be configured to pass through the one or more openings 102 of the zipper pull tab 101. Further, the one or more openings 102 may comprise the proximal opening 102 disposed on the proximal portion of the zipper pull tab 101. Further, the proximal portion is adjacent to the slider bridge 103 of the zipper slider 100. Further, the one or more openings 102 may comprise the distal opening 1016 disposed on the distal portion of the zipper pull tab 101. Further, the one or more protrusions 204 may be configured to pass through the proximal opening 102.

In some embodiments, the top component 201 may comprise the top outer surface 1002 and the top inner surface 1004 opposing the top outer surface 1002. Further, the top outer surface 1002 is characterized by the top curvature. Further, the top curvature may enlarge the gripping surface of the top outer surface 1002.

In some embodiments, the bottom component 202 may comprise the side barrier 207 disposed along at least a portion of the periphery of the bottom component 202. Further, the side barrier 207 may comprise the contiguous wall 1010 (as shown in FIG. 10) disposed on the bottom inner surface 1006. Further, the contiguous wall 1010 is characterized by the wall height. Further, the side barrier 207 is configured for preventing sliding out of the zipper pull tab 101 from the interior space 208.

In some embodiments, the one or more top fastening components 205(*a*) may comprise the male part 205(*a*) of the one or more snap-fit joints 205(*a*)-205(*b*). Further, the one or more bottom fastening components 205(*b*) may comprise the female part 205(*b*) of the one or more snap-fit joints 205(*a*)-205(*b*).

In some embodiments, the one or more top fastening components 205(*a*) may comprise the first magnetic part 1022 of the one or more magnetic clasps 206. Further, the bottom fastening component may comprise the second magnetic part 1020 of the one or more magnetic clasps 206. Further, each of the first magnetic part 1022 and the second magnetic part 1020 may comprise the ferromagnetic substance.

In further embodiments, the zipper pull tab attachment 2000 for providing the enlarged gripping surface to the zipper pull tab 101 is disclosed.

Further, the zipper pull tab attachment 2000 may include the top component 201 comprising the one or more top fastening components 205(*a*). Further, the one or more top fastening components 205(*a*) may comprise the channel region 2102. Further, the channel region 2102 may be configured for mating with the one or more protrusions 204.

Further, the zipper pull tab attachment 2000 may include the bottom component 202 which may be configured to be removably attached to at least a portion of the top component 201.

Further, the bottom component 202 may include the bottom outer surface 1008 and the bottom inner surface 1006 opposing the bottom outer surface 1008. Further, the bottom outer surface 1008 is characterized by the bottom curvature. Further, the bottom curvature may enlarge the gripping surface of the bottom outer surface 1008. Further, the top component 201 may include the top outer surface 1002 and the top inner surface 1004 opposing the top outer surface 1002. Further, the top outer surface 1002 is characterized by the top curvature. Further, the top curvature may enlarge the gripping surface of the top outer surface 1002. Further, the top component 201 and the bottom component 202 form the interior space 208 when attached together. Further, the interior space 208 may be configured for encasing at least a part of the zipper pull tab 101. Further, the bottom component 202 may include the one or more bottom fastening components 205(*b*). Further, the one or more top fastening components 205(*a*) may be configured to mate with the one or more bottom fastening components 205(*b*).

Further, the bottom component 202 may include the one or more protrusions 204. Further, the one or more protrusions 204 may be configured to pass through the one or more openings 102 of the zipper pull tab 101. Further, the one or more openings 102 may comprise the proximal opening 102 disposed on the proximal portion of the zipper pull tab 101. Further, the proximal portion is adjacent to the slider bridge 103 of the zipper slider 100. Further, the one or more openings 102 may comprise the distal opening 1016 disposed on the distal portion of the zipper pull tab 101. Further, the one or more protrusions 204 may be configured to pass through the proximal opening 102.

In some embodiments, the one or more top fastening components 205(*a*) may comprise the male part 205(*a*) of the one or more snap-fit joints 205(*a*)-205(*b*). Further, the one or more bottom fastening components 205(*b*) may comprise the female part 205(*b*) of the one or more snap-fit joints 205(*a*)-205(*b*).

In some embodiments, the one or more top fastening components 205(*a*) may comprise the first magnetic part 1022 of the one or more magnetic clasps 206. Further, the one or more bottom fastening component 205(*b*) may comprise the second magnetic part 1020 of the one or more magnetic clasps 206. Further, each of the first magnetic part 1022 and the second magnetic part 1020 may comprise the ferromagnetic substance.

In some embodiments, the zipper pull tab attachment 2000 may include the hinge 209 which may be configured to attach at least the first portion 1012 of the top component 201 with the second portion 1014 of the bottom component 202. Further, the hinge 209 may facilitate pivotal movement of the top component 201 in relation to the bottom component 202.

FIG. 1 is a top view of a conventional zipper slider and pull tab assembly 1001, in accordance with prior art. Accordingly, the zipper slider and pull tab assembly 1001 may include the typical zipper slider 100 and the pull tab 101. Further, the zipper slider and pull tab assembly 1001 may include a bottom pillar of the slider bridge 103 extending through the attachment hole 102 of the pull tab 101 before connecting to the zipper slider (or slider) 100, such that the pull tab 101 is attached around the slider bridge 103 through a space 104 underneath the bridge.

Figure 2:
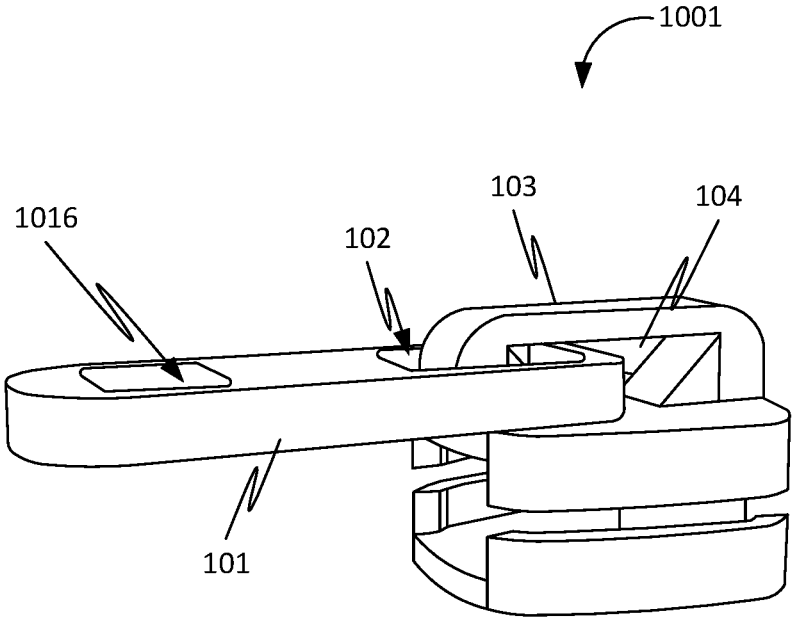
FIG. 2 is a right-side view of the zipper slider and pull tab assembly 1001, in accordance with prior art.

FIG. 2 is a right-side view of the zipper slider and pull tab assembly 1001, in accordance with prior art.

Figure 3:
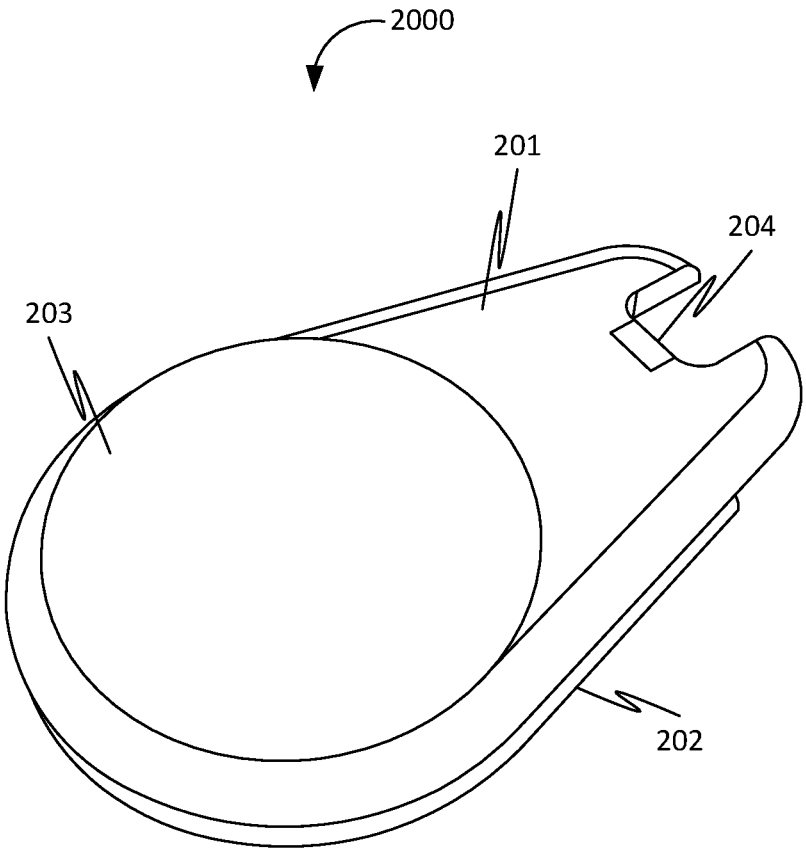
FIG. 3 is a front top right-side perspective view of a zipper pull tab attachment 2000, in accordance with some embodiments.

FIG. 3 is a front top right-side perspective view of the zipper pull tab attachment 2000, in accordance with some embodiments. Accordingly, the zipper pull tab attachment 2000 may include the top component 201 and the bottom component 202 connected to the top component 201.

Figure 4:
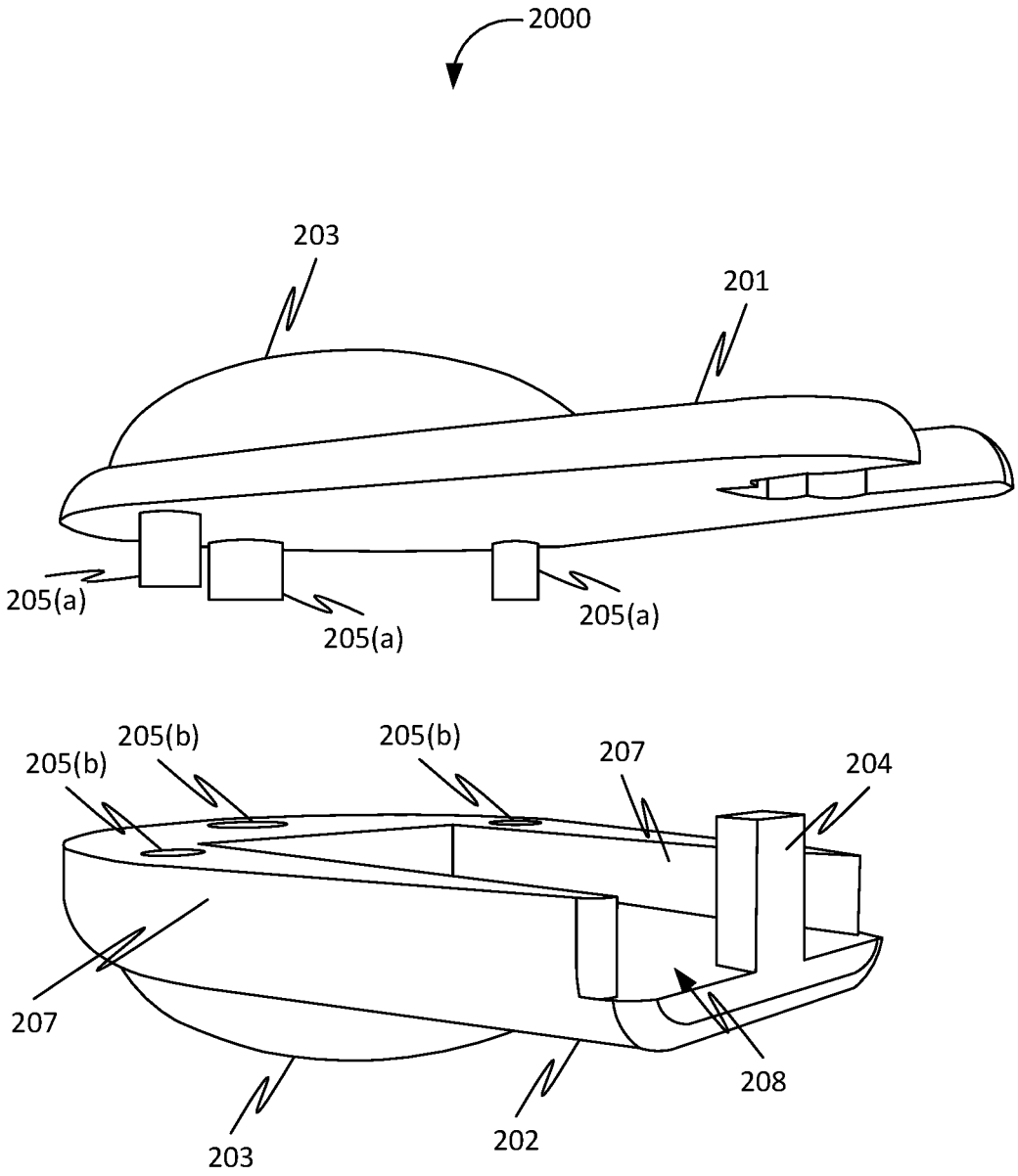
FIG. 4 is an exploded view of the top component 201 and the bottom component 202 of the zipper pull tab attachment 2000, in accordance with some embodiments.
Figure 5:
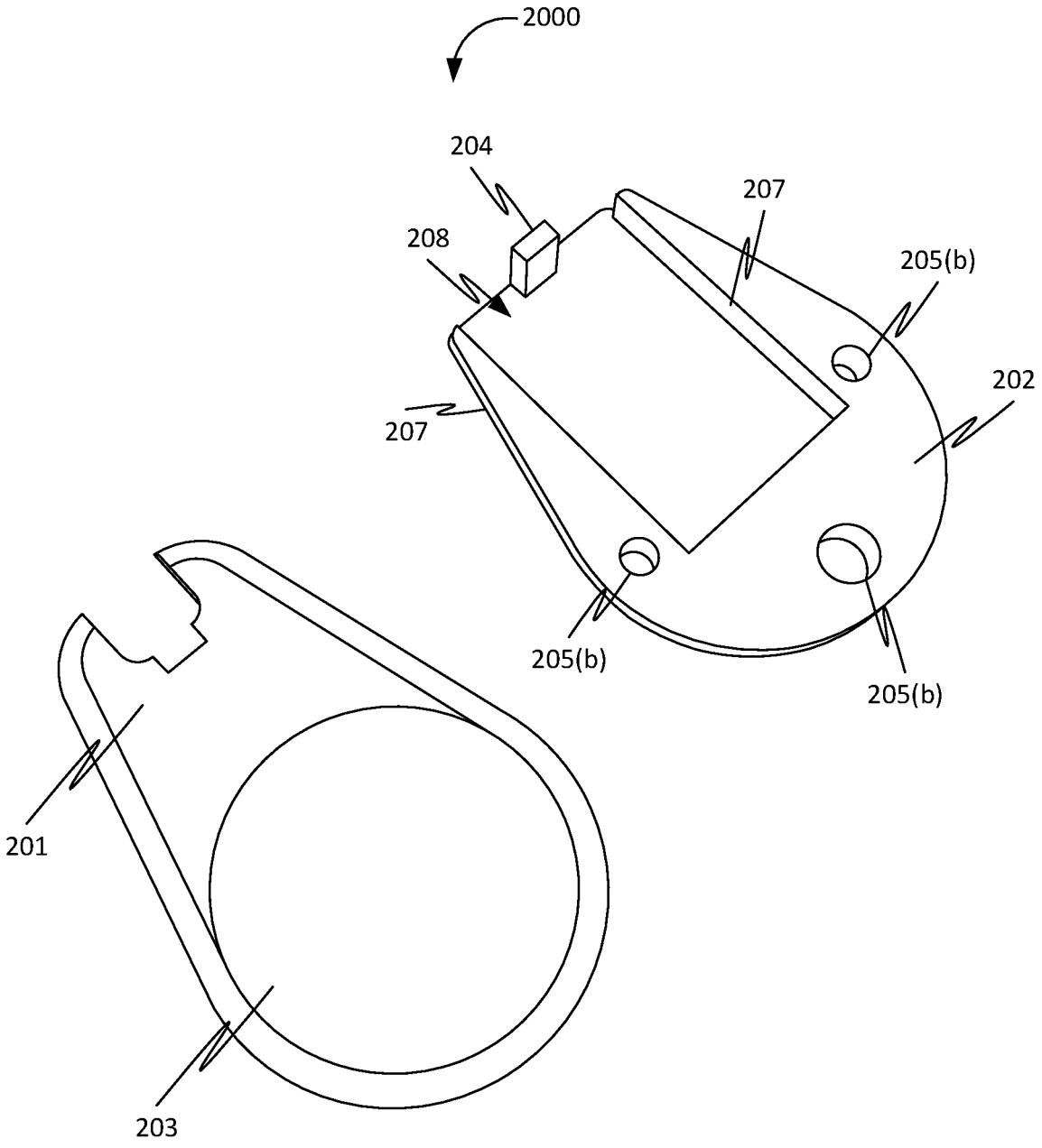
FIG. 5 is a top view of the zipper pull tab attachment 2000 when the top component 201 and the bottom component 202 are not connected, in accordance with some embodiments.
Figure 6:
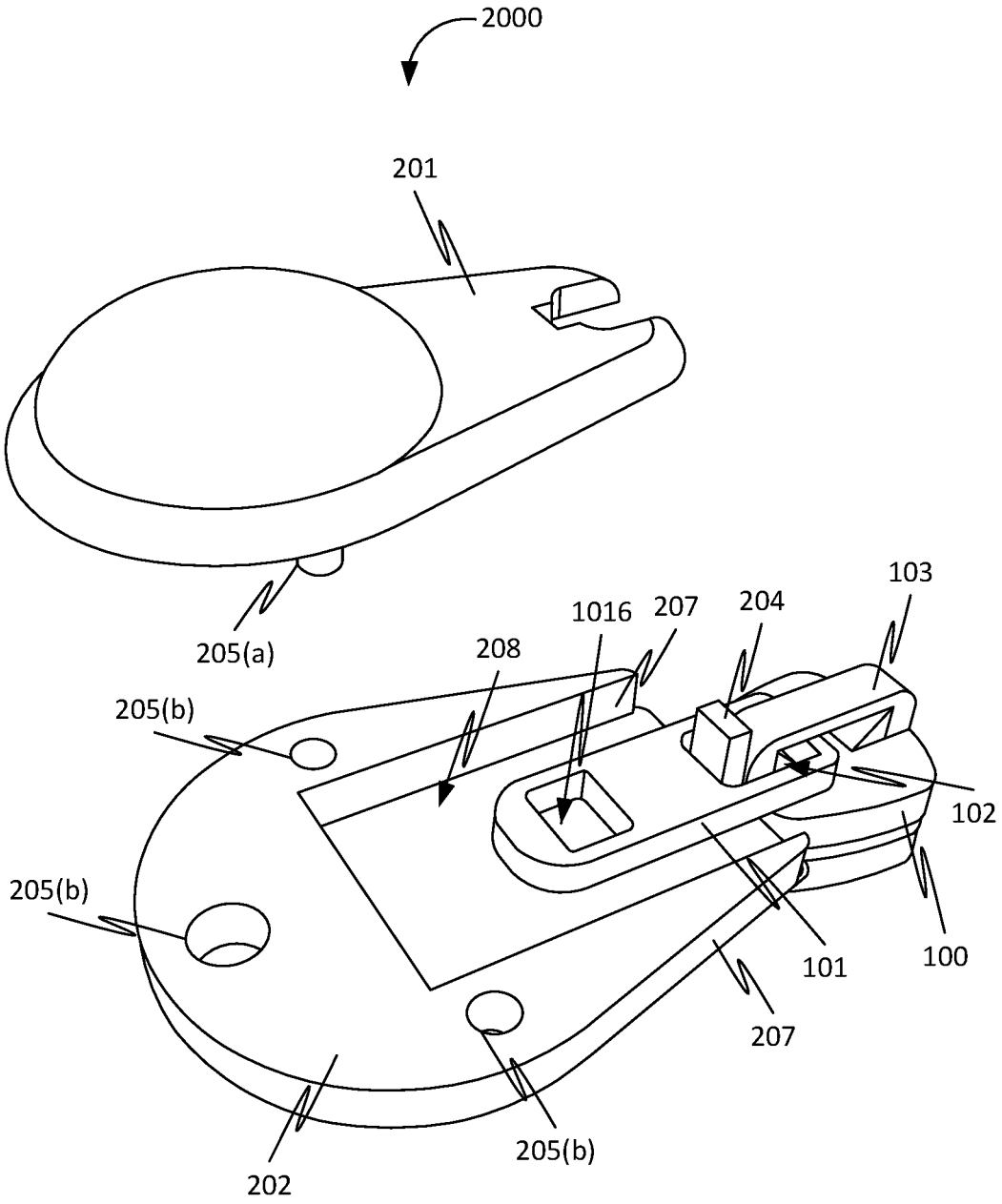
FIG. 6 is an exploded view of the zipper pull tab attachment 2000 attached to the zipper pull tab 101, in accordance with some embodiments.

Further, the top component 201 may include the pegs 205(*a*) which fit snugly into corresponding cavities 205(*b*) in the bottom component, as shown in FIG. 4-FIG. 6. When aligned and pushed together, the top component 201 and the bottom component 202 may be held together by the friction of the pegs 205 (*a*) against the cavities 205 (*b*). The top component 201 and the bottom component 202 may be pulled apart by applying a small amount of force. Further, an additional cavity 208 provides sufficient space for the pull tab 101 to be enclosed within the zipper pull tab attachment 2000, as shown in FIG. 6. The top component 201 and the bottom component 202 may feature side barriers 207 to prevent the pull tab 101 from partially sliding out along one side of the zipper pull tab attachment 2000 when attached. the top component 201 and the bottom component 202 may include a rounded form 203 along part of their exposed faces. The shape of the rounded form 203 may be but is not limited to, a dome, egg, teardrop, sphere, or spheroid.

Figure 7:
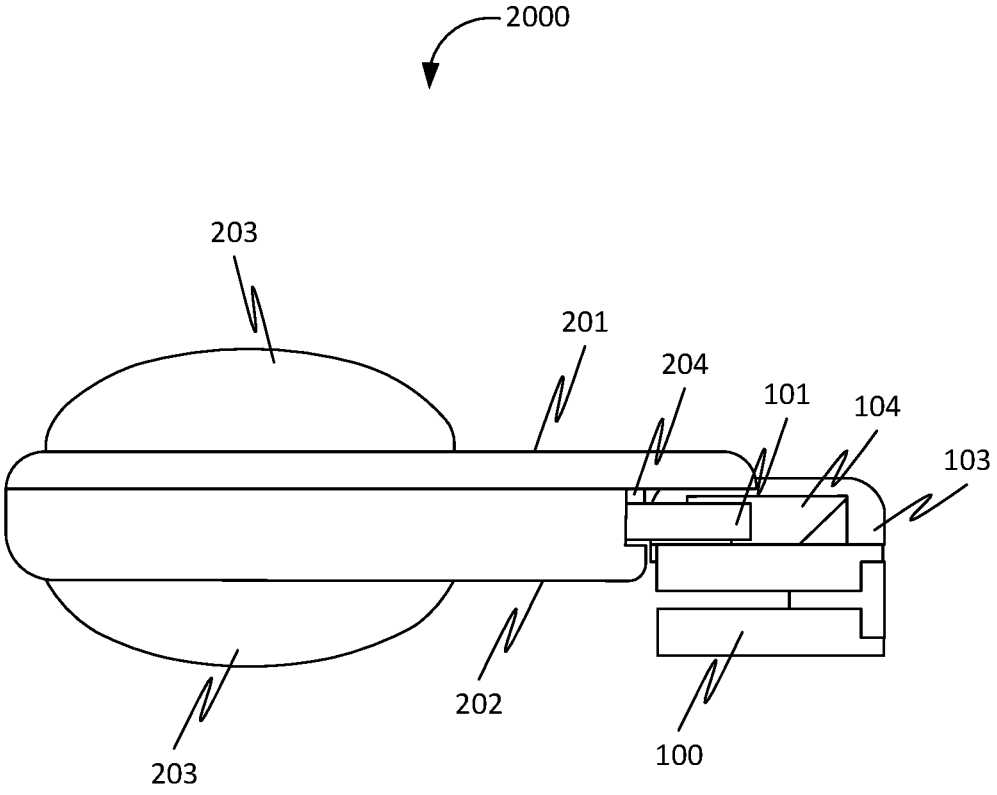
FIG. 7 is a right-side view of the zipper pull tab attachment 2000 attached to the zipper pull tab 101, in accordance with some embodiments.
Figure 13:
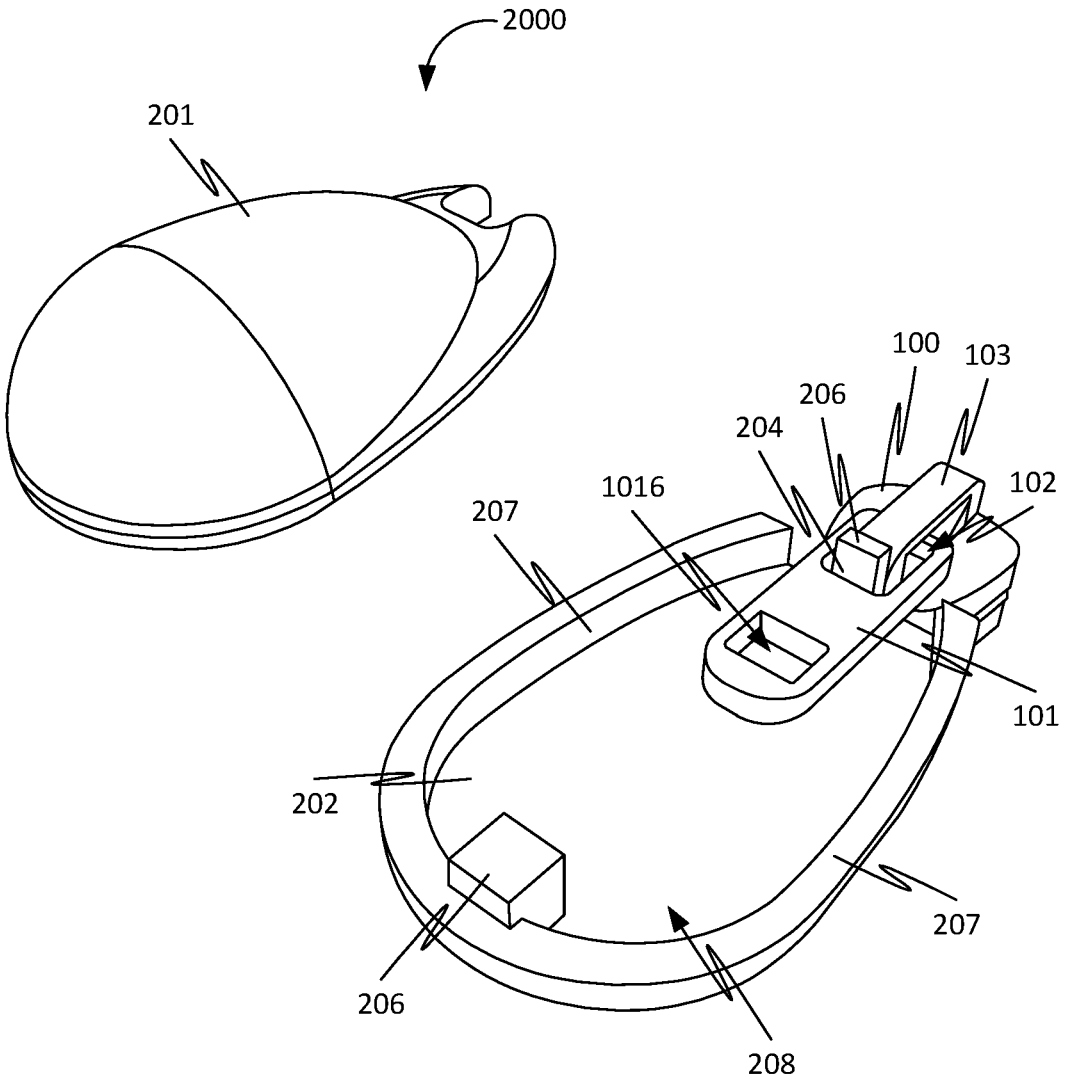
FIG. 13 is a front top right side perspective view of the zipper pull tab attachment 2000 attached to the zipper pull tab 101, when the top component 201 and the bottom component 202 are not connected, in accordance with some embodiments.
Figure 14:
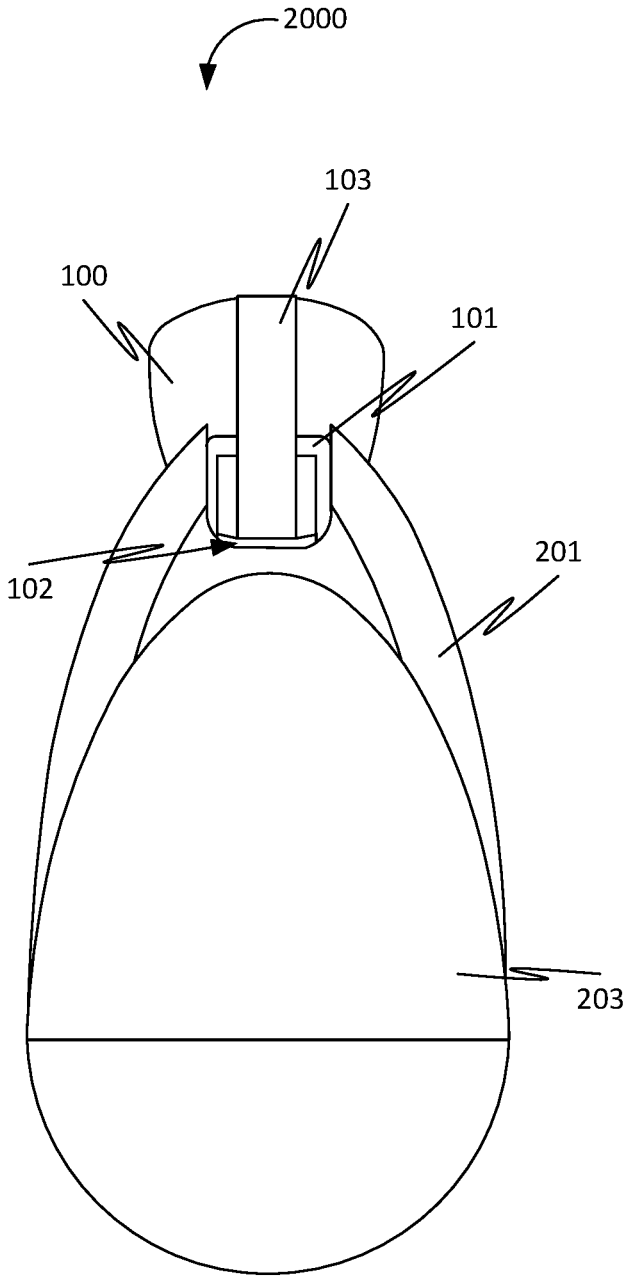
FIG. 14 is a top view of the zipper pull tab attachment 2000 in the egg shape attached to the zipper pull tab 101, in accordance with some embodiments.

Further, the zipper pull tab attachment 2000 may include an attachment component comprising the extrusion 204 from the bottom component 202, as shown in FIG. 4-FIG. 8, FIG. 10, FIG. 11, FIG. 13, FIG. 20-FIG. 23, and FIG. 25-FIG. 30. The bottom component 202 may be placed underneath the zipper pull tab 101 with the extrusion 204 slid through the attachment hole 102 of the pull tab 101, as shown in FIG. 6. The extrusion 204 fits through a gap remaining in the attachment hole 102, past the bottom pillar of the slider bridge 103. The top component 201 may be placed above the pull tab 101. Further, the pegs 205 (*a*) (or friction pegs) may be applied to secure the top component 201 and the bottom component 202 to each other and encase the pull tab 101, while the extrusion 204 secures the zipper pull tab attachment 2000 to the pull tab 101, as shown in FIG. 7, FIG. 9, and FIG. 14. The extrusion 204 may be straight, L-shaped, or curved in a C or U-shape hook. The extrusion 204 may meet and potentially connect to the top component 201 using a magnet or clasp. The extrusion 204 may also be from the top component 201 going towards the bottom component 202.

As shown FIG. 10, the top component 201 and the bottom component 202 may be connected using hinges 209 along one side, and magnetic closure 206 on the opposite side, enabling the top component 201 and the bottom component 202 may to rotate along the hinged side and come apart along the opposing side face, and the front and back faces. Further, the hinges 209 may be replaced with other suitable rotating mechanism including, but not limited to, flexible plastic.

In another alternative embodiment, as shown in FIG. 11-FIG. 14, the top component 201 and bottom component 202 may be connected solely through the suitable placement of the magnetic closures 206 and may be pulled apart completely. Further, the magnetic closures 206 may be replaced with other suitable fastening mechanisms including, but not limited to, friction clasp.

Further, the zipper pull tab attachment 2000 may include the cavity 208 for the pull tab 101 to be enclosed within the zipper pull tab attachment 2000 when attached. Further, the top component 201 and bottom component 202 may be placed above and underneath the pull tab 101, respectively, as shown in FIG. 10 and FIG. 13. When connected, the top component 201 and the bottom component 202 may encase the pull tab 101, as shown in FIG. 14. In another alternative embodiment, as shown in FIG. 15-FIG. 18, the zipper pull tab attachment 2000 may include a single body component 200 with the cavity 208. As shown in FIG. 17, the cavity 208 in the zipper pull tab attachment 2000 slides over the pull tab 101 to encase it. Further, the top component 201 and the bottom component 202 may feature the rounded form 203 along part of their exposed faces, such as the egg shape of the zipper pull tab attachment 2000 as shown in FIG. 11-FIG. 14, and the rounded teardrop shape of the zipper pull tab attachment 2000 as shown in FIG. 15-FIG. 18.

Further, in an alternative embodiment, the attachment component 204 may be a clasp mechanism such as, but not limited to, a hook clasp or pin clasp which fits through the space 104 underneath the zipper slider bridge 103 and connects to the zipper pull tab attachment 2000 to secure the zipper pull tab attachment 2000 to the zipper slider 100. In this embodiment, since the attachment is to the zipper slider 100, the pull tab 101 is not required for the zipper pull tab attachment 2000 to function.

Figure 17:
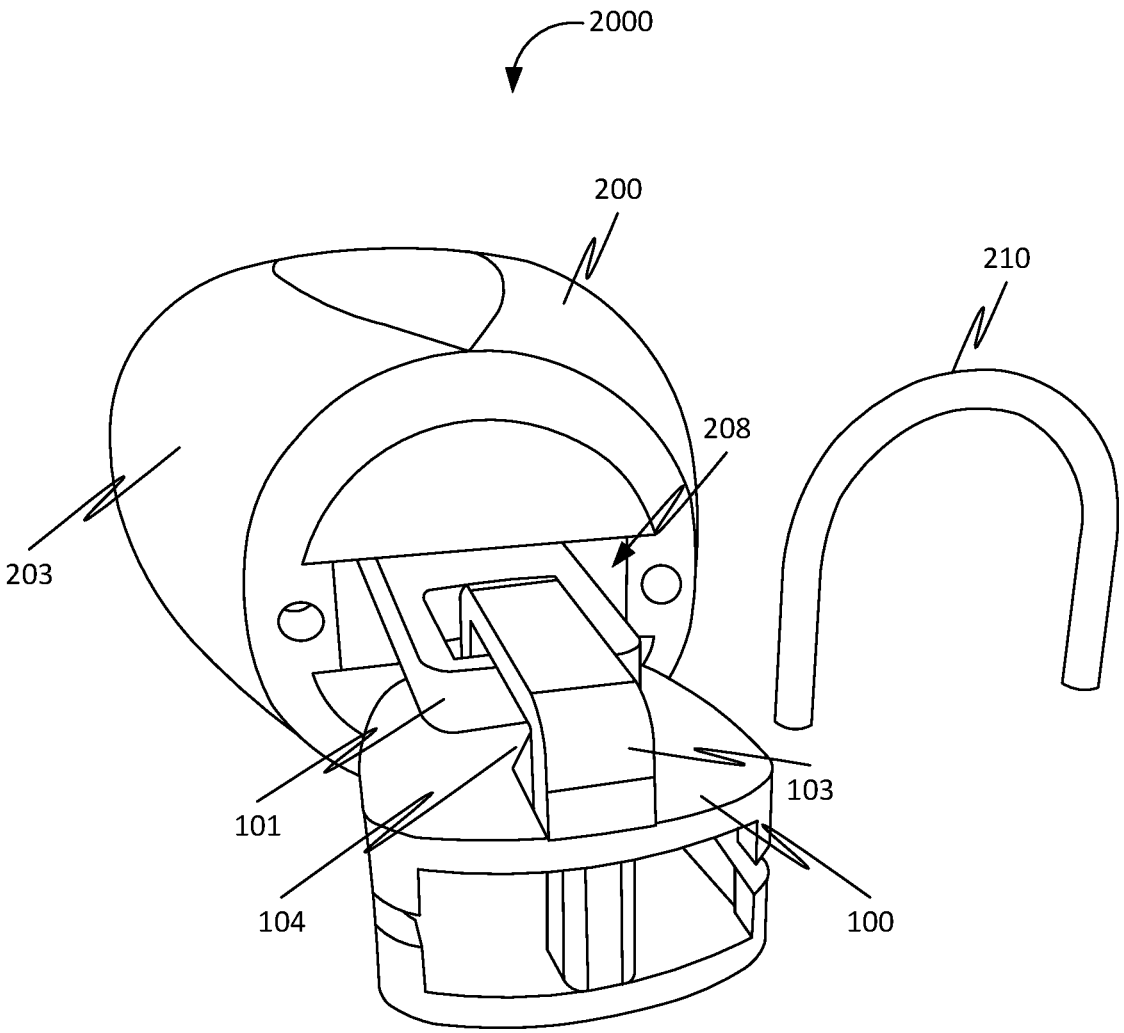
FIG. 17 is a top rear left-side perspective view of the zipper pull tab attachment 2000 with the zipper pull tab 101 inserted, when the friction hook clasp 210 is disengaged, in accordance with some embodiments.
Figure 18:
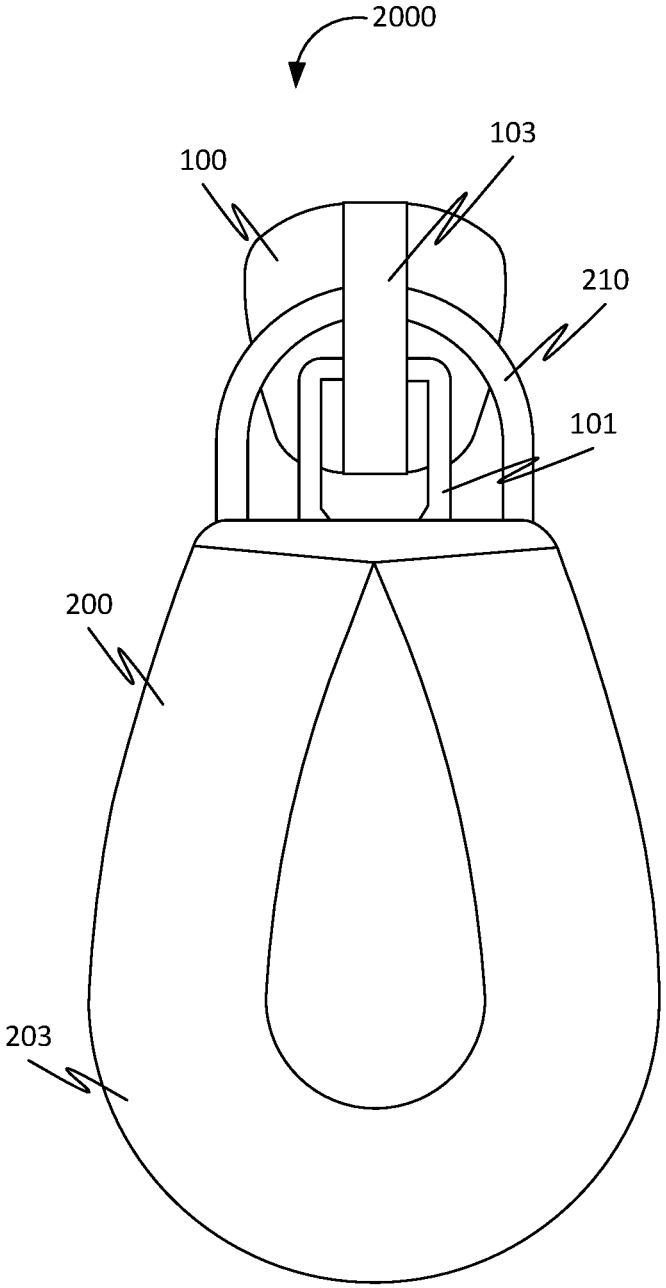
FIG. 18 is a top view of the zipper pull tab attachment 2000 with the zipper pull tab 101 inserted, in accordance with some embodiments.

FIG. 17 and FIG. 18 illustrate the zipper pull tab attachment 2000 attached around the zipper slider bridge 103 using a friction hook clasp 210. Further, in another alternative embodiment, the attachment component 204 is a clasp mechanism such as, but not limited to, hook, toggle, or magnetic clasp extending from the bottom component 202 to the top component 201, or vice versa, through the attachment hole 102 of the pull tab 101. The clasp may fit through the gap remaining in the attachment hole 102, past the bottom pillar of the slider bridge 103. The attachment component 204 may also be a pin clasp that can be inserted through a hole in the bottom component 202 and extends through the attachment hole 102 of the pull tab 101, but does not attach to the top component 201, or vice versa.

FIG. 4 is an exploded view of the top component 201 and the bottom component 202 of the zipper pull tab attachment 2000, in accordance with some embodiments.

FIG. 5 is a top view of the zipper pull tab attachment 2000 when the top component 201 and the bottom component 202 are not connected, in accordance with some embodiments.

FIG. 6 is an exploded view of the zipper pull tab attachment 2000 attached to the zipper pull tab 101, in accordance with some embodiments.

FIG. 7 is a right-side view of the zipper pull tab attachment 2000 attached to the zipper pull tab 101, in accordance with some embodiments.

Figure 8:
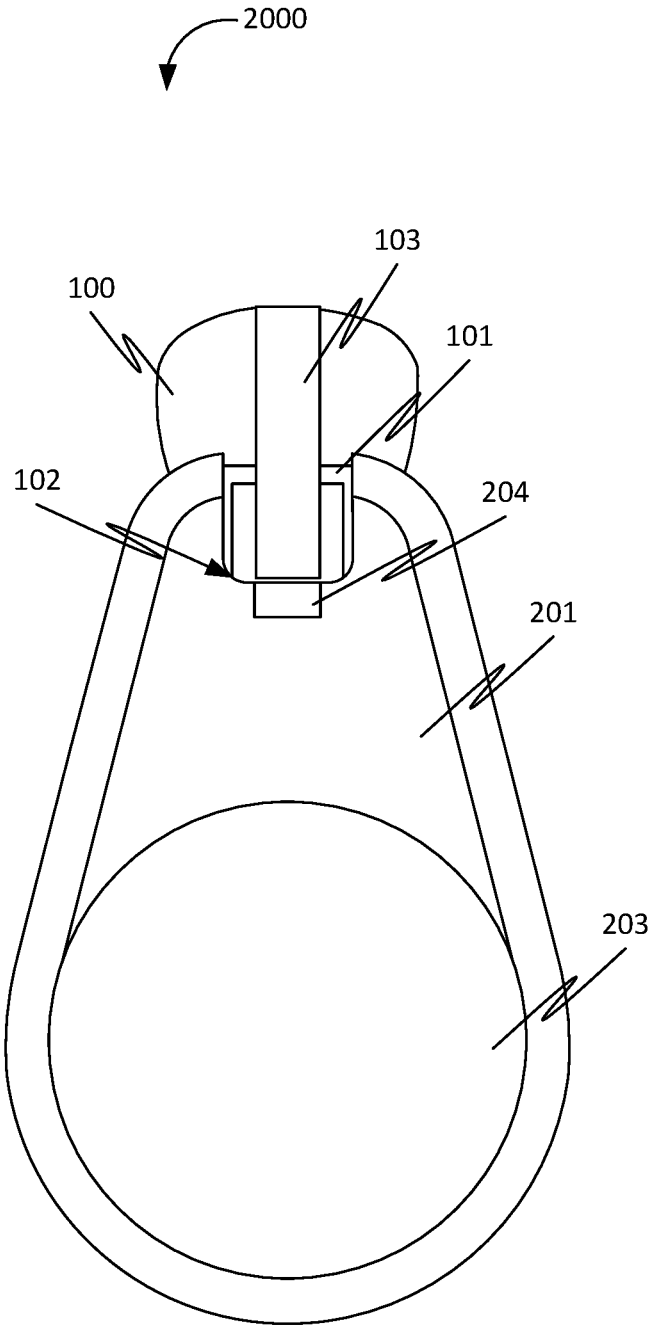
FIG. 8 is a top view of the zipper pull tab attachment 2000 attached to the zipper pull tab 101, in accordance with some embodiments.
Figure 9:
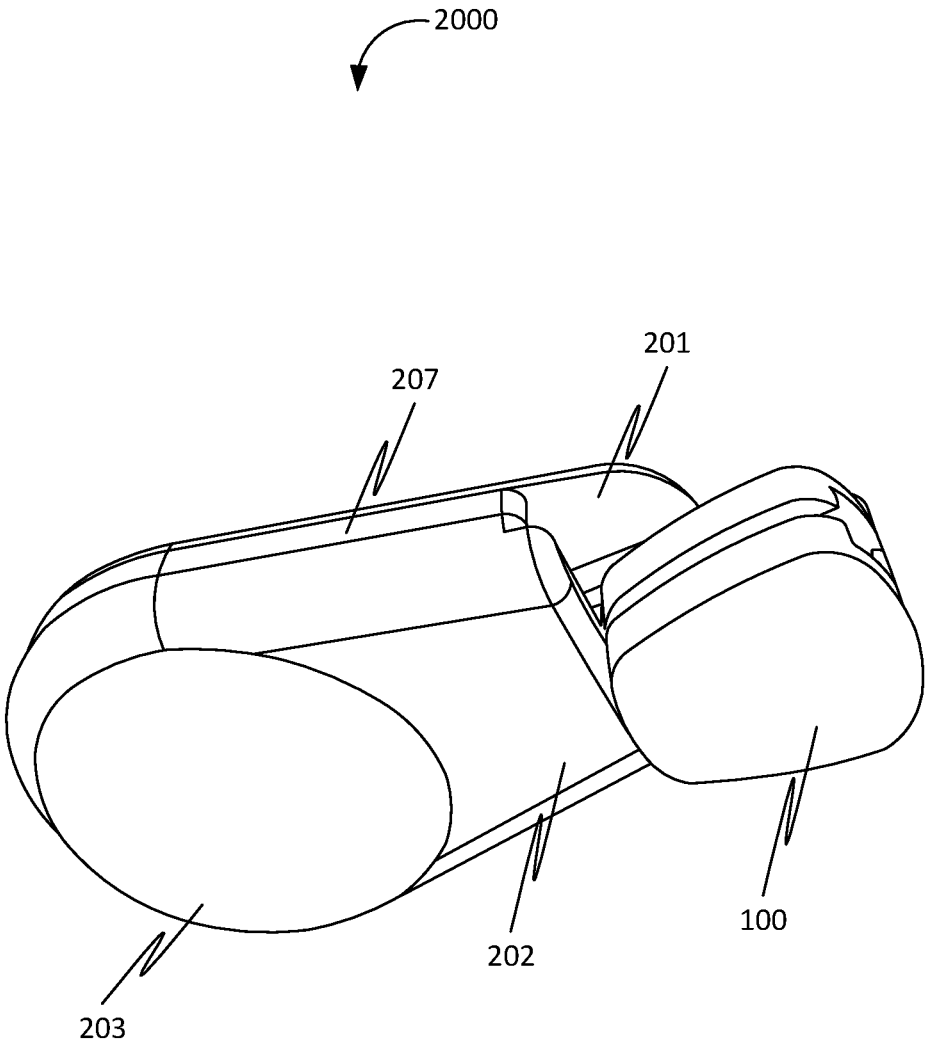
FIG. 9 is a bottom rear left-side perspective view of the zipper pull tab attachment 2000 attached to the zipper pull tab 101, in accordance with some embodiments.

FIG. 8 is a top view of the zipper pull tab attachment 2000 attached to the zipper pull tab 101, in accordance with some embodiments.

FIG. 9 is a bottom rear left-side perspective view of the zipper pull tab attachment 2000 attached to the zipper pull tab 101, in accordance with some embodiments.

FIG. 10 is a top front right-side perspective view of the zipper pull tab attachment 2000 attached to the zipper pull tab 101, in accordance with some embodiments. Accordingly, the top component 201 and the bottom component 202 of the zipper pull tab attachment 2000 may be attached using the hinge 209.

Figure 11:
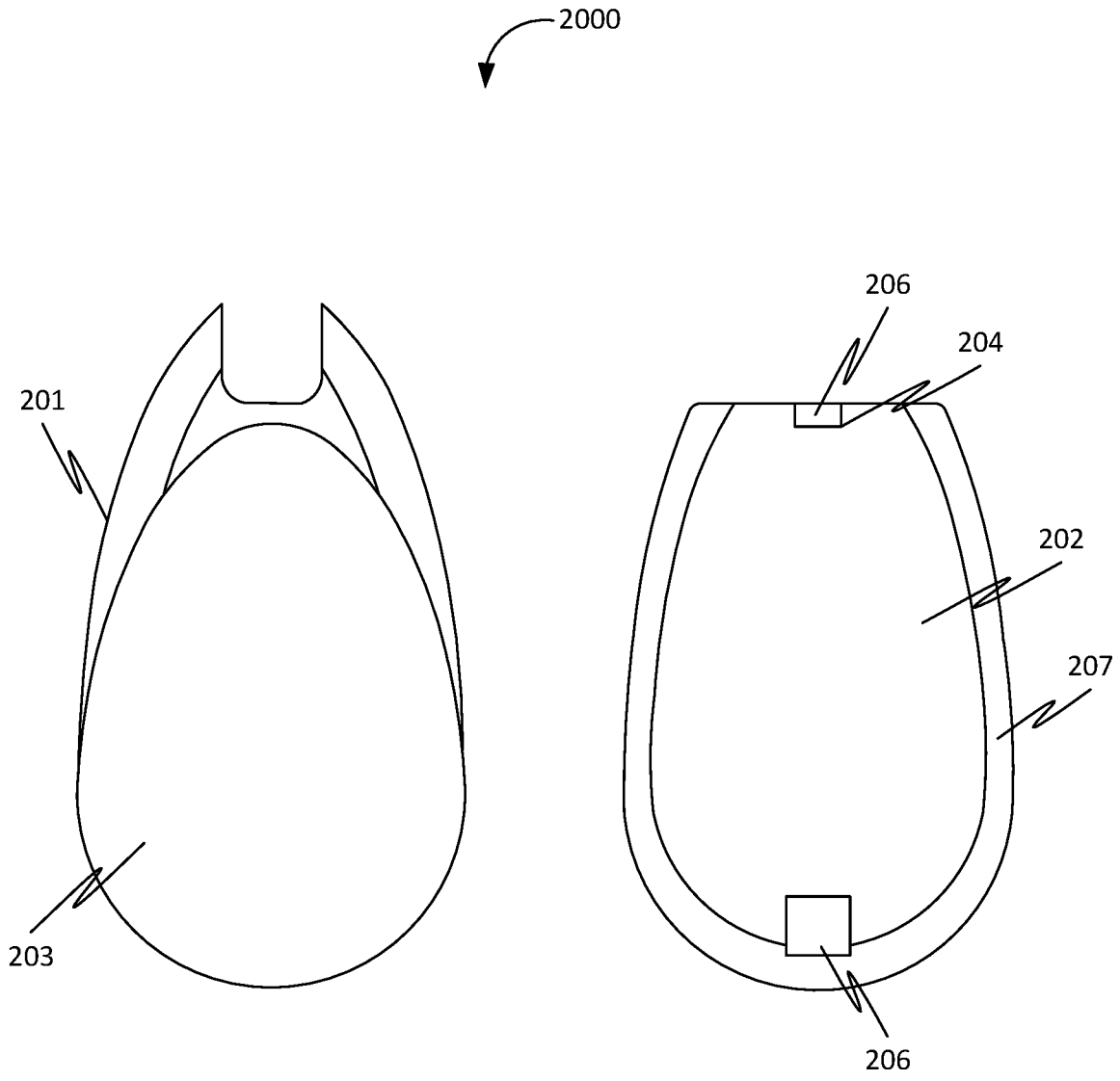
FIG. 11 is a top view of the top component 201 and the bottom component 202 in an egg shape, when the top component 201 and the bottom component 202 are not connected, in accordance with some embodiments.

FIG. 11 is a top view of the top component 201 and the bottom component 202 in an egg shape, in accordance with some embodiments.

Figure 12:
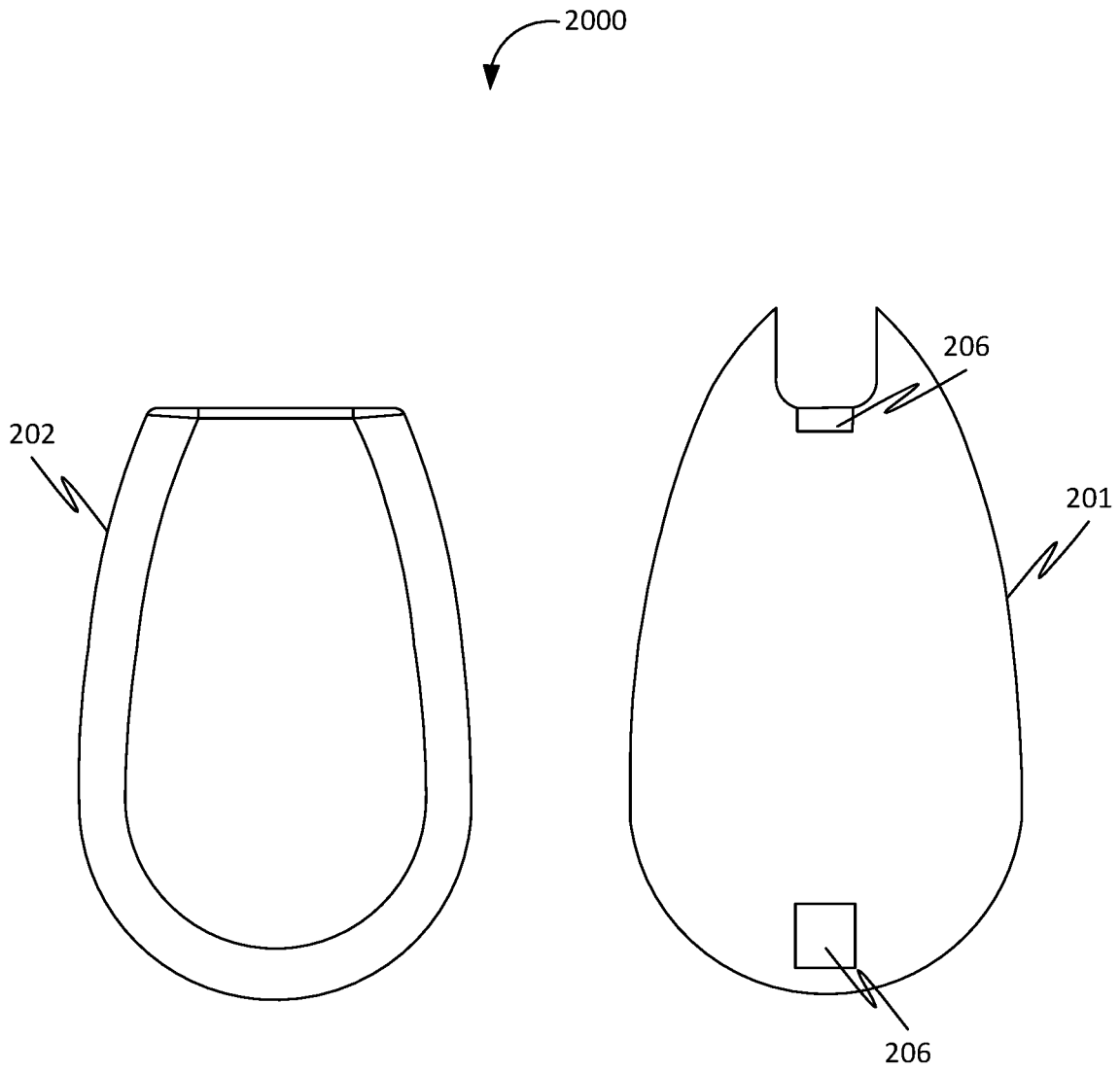
FIG. 12 is a bottom view of the top component 201 and the bottom component 202 in the egg shape, when the top component 201 and the bottom component 202 are not connected, in accordance with some embodiments.

FIG. 12 is a bottom view of the top component 201 and the bottom component 202 in the egg shape, in accordance with some embodiments.

FIG. 13 is a front top right side perspective view of the zipper pull tab attachment 2000 attached to the zipper pull tab 101, in accordance with some embodiments.

FIG. 14 is a top view of the zipper pull tab attachment 2000 in the egg shape attached to the zipper pull tab 101, in accordance with some embodiments.

Figure 15:
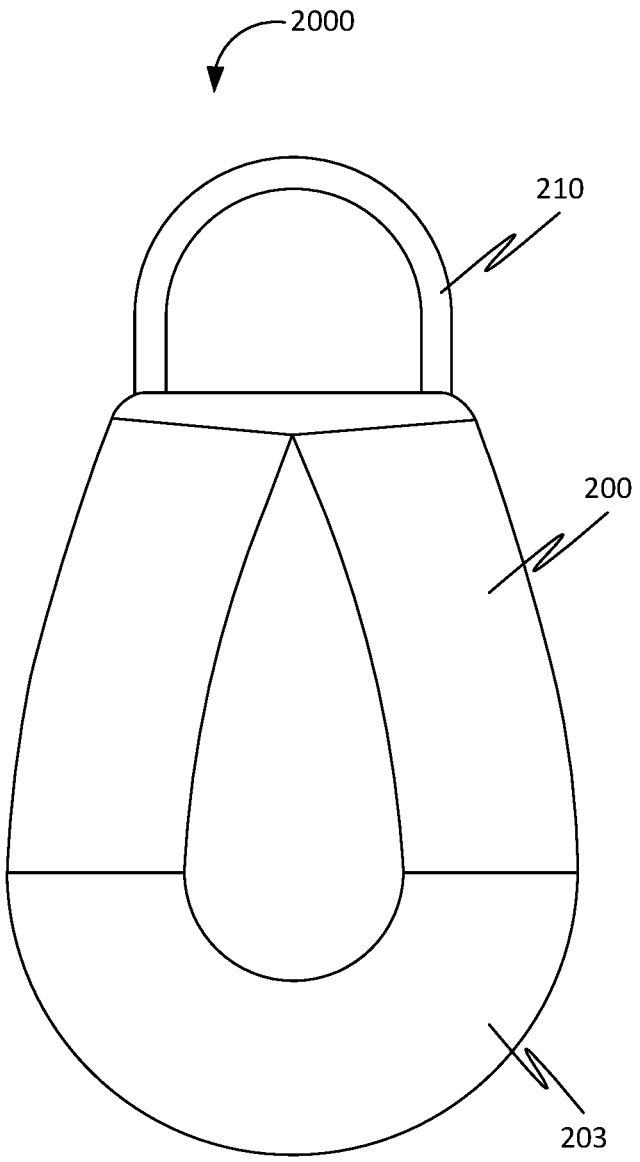
FIG. 15 is a top view of the zipper pull tab attachment 2000 in a teardrop shape, in accordance with some embodiments.

FIG. 15 is a top view of the zipper pull tab attachment 2000 in a teardrop shape, in accordance with some embodiments.

Figure 16:
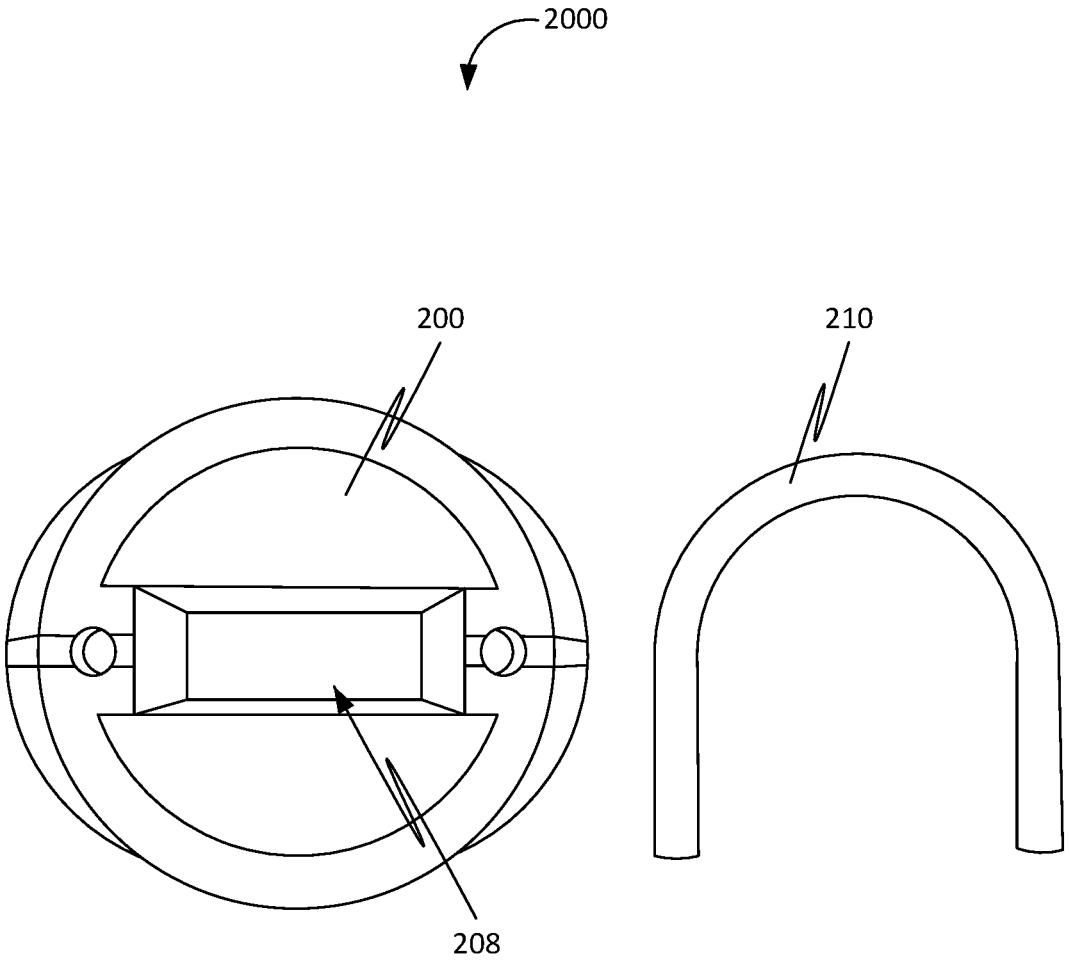
FIG. 16 illustrates the zipper pull tab attachment 2000 in the teardrop shape, when a friction hook clasp 210 is disengaged, in accordance with some embodiments.

FIG. 16 illustrates the zipper pull tab attachment 2000 in the teardrop shape, in accordance with some embodiments.

FIG. 17 is a top rear left-side perspective view of the zipper pull tab attachment 2000 with the zipper pull tab 101 inserted, in accordance with some embodiments.

FIG. 18 is a top view of the zipper pull tab attachment 2000 with the zipper pull tab 101 inserted, in accordance with some embodiments. Accordingly, the zipper pull tab attachment 2000 may be attached to the zipper slider 100.

Figure 19:
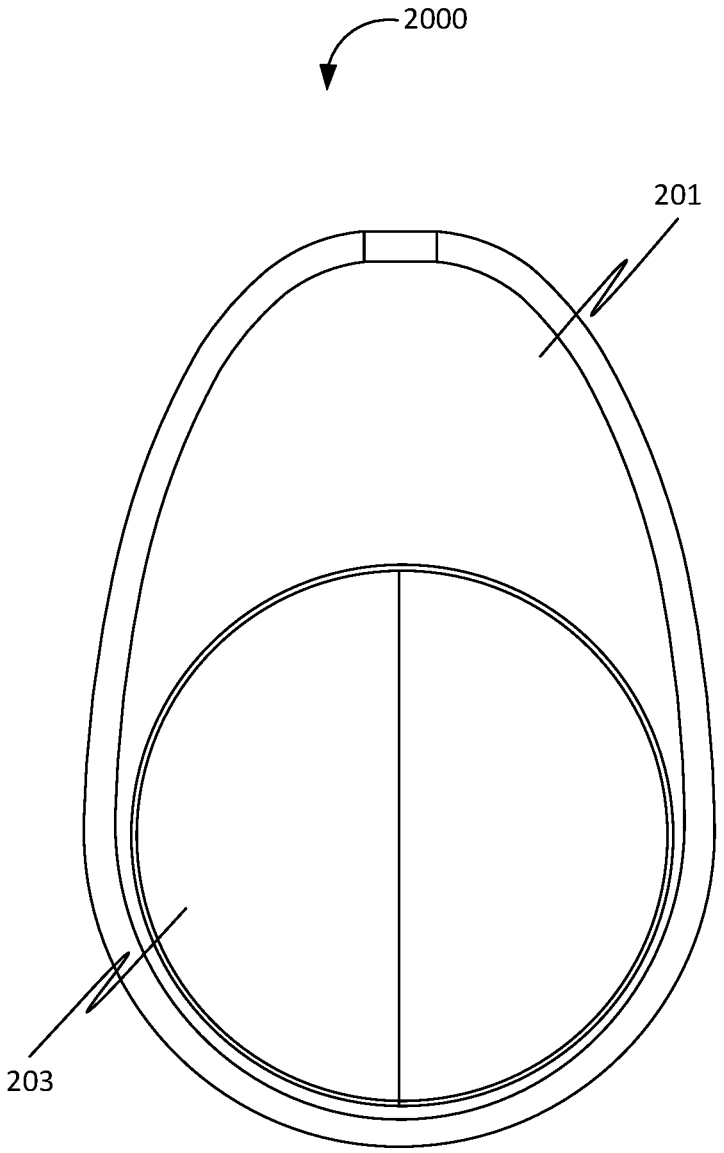
FIG. 19 is a top view of the zipper pull tab attachment 2000, in accordance with some embodiments.
Figure 20:
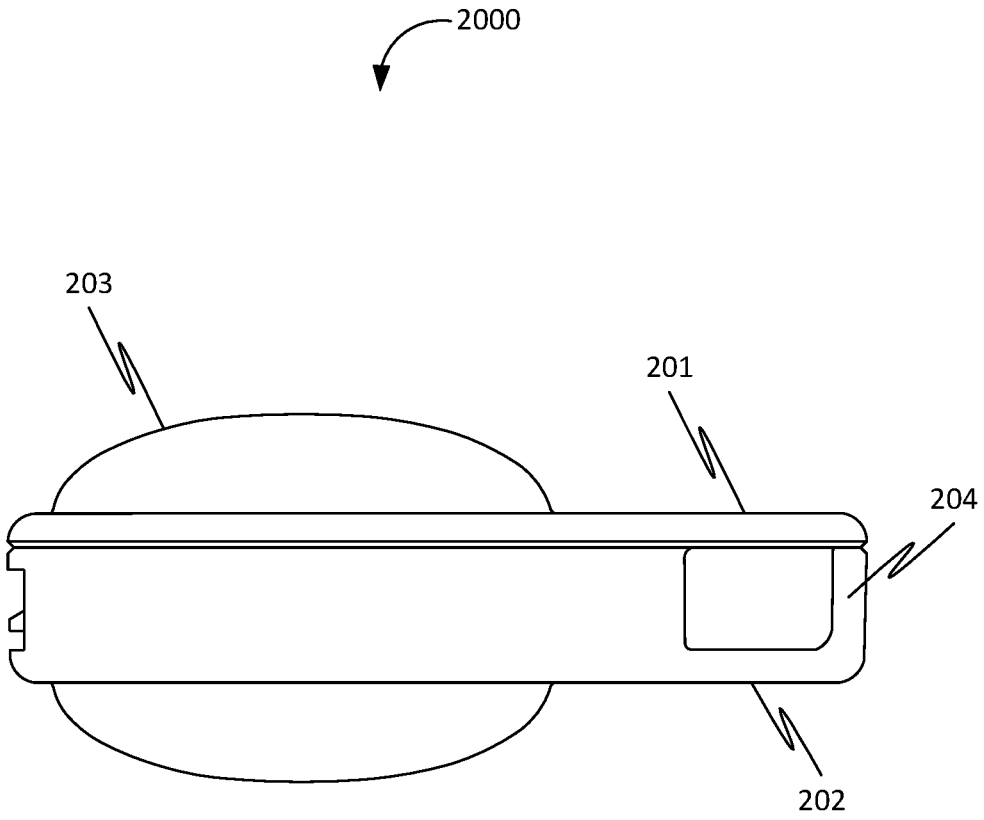
FIG. 20 is a right-side view of the zipper pull tab attachment 2000, in accordance with some embodiments.

FIG. 19 is a top view of the zipper pull tab attachment 2000, in accordance with some embodiments. Accordingly, the zipper pull tab attachment 2000 provides an alternative, after-market solution to the existing zipper pull tab 101. Further, the zipper pull tab attachment 2000 may be attached to the zipper pull tab 101. When attached, the zipper pull tab attachment 2000 securely encases the pull tab 101 within it and provides for a unified operation of the zipper pull tab attachment 2000 and the zipper pull tab 101. Further, the user cannot directly access the encased pull tab 101 and must grip and pull on the zipper pull tab attachment 2000 instead to open or close the zipper. The zipper pull tab attachment 2000 may be large enough to be gripped by wrapping all or several fingers and/or the palm of a hand around it, i.e., the zipper pull tab attachment 2000 does not require a precision grip to operate. The zipper pull tab attachment 2000 consists of the top component 201 and the bottom component 202 that connect using snap-fit joints 205 (*a*). FIG. 19 shows a top view of the zipper pull tab attachment 2000 and FIG. 20 shows a side view of the zipper pull tab attachment 2000 when the top component (or top plate) 201 and the bottom plate 202 (or bottom plate) are connected. The top component 201 and the bottom component 202 may feature the rounded form 203 along part of their exposed faces. The bottom component 202 features the extrusion 204 that functions as the attachment component 204 to the zipper pull tab 101.

FIG. 20 is a right-side view of the zipper pull tab attachment 2000, in accordance with some embodiments.

FIG. 21 illustrates the interiors of the top component 201 and the bottom component 202, containing mating snap-fit joints 205(*a*) and 205(*b*), in accordance with some embodiments. Further, the bottom component 202 features side barriers 207 to prevent the zipper pull tab 101 from potentially partially sliding out along one side of the zipper pull tab attachment 2000 when attached. Further, the cavity 208 provides space for the pull tab 101 to be contained within the zipper pull tab attachment 2000.

Figure 22:
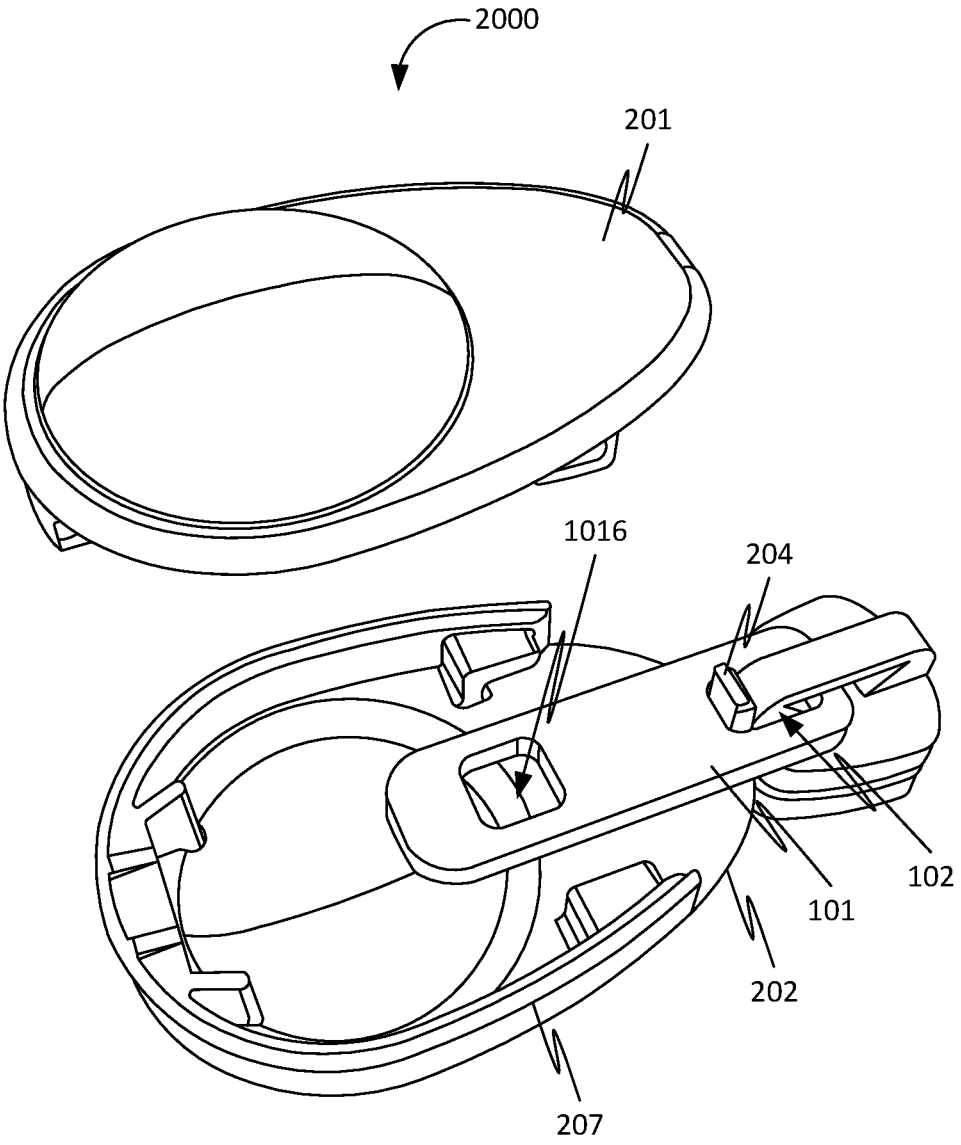
FIG. 22 is an exploded view of the top component 201 and the bottom component 202 of the zipper pull tab attachment 2000 attached to the zipper pull tab 101, in accordance with some embodiments.

FIG. 22 is an exploded view of the top component 201 and the bottom component 202 of the zipper pull tab attachment 2000 attached to the zipper pull tab 101, in accordance with some embodiments. The bottom component 202 may be placed underneath the zipper pull tab 101 with the extrusion 204 slid through the attachment hole 102 of the pull tab 101. The extrusion 204 fits through the gap remaining in the attachment hole 102, past the bottom pillar of the slider bridge 103. The top plate 201 may slide over the bottom component 202 to engage the snap-fit joints 205(*a*)-205(*b*) and secure the top component 201 and the bottom component 202 to each other and encase the pull tab 101, while the extrusion 204 secures the zipper pull tab attachment 2000 to the pull tab 101.

Figure 23:
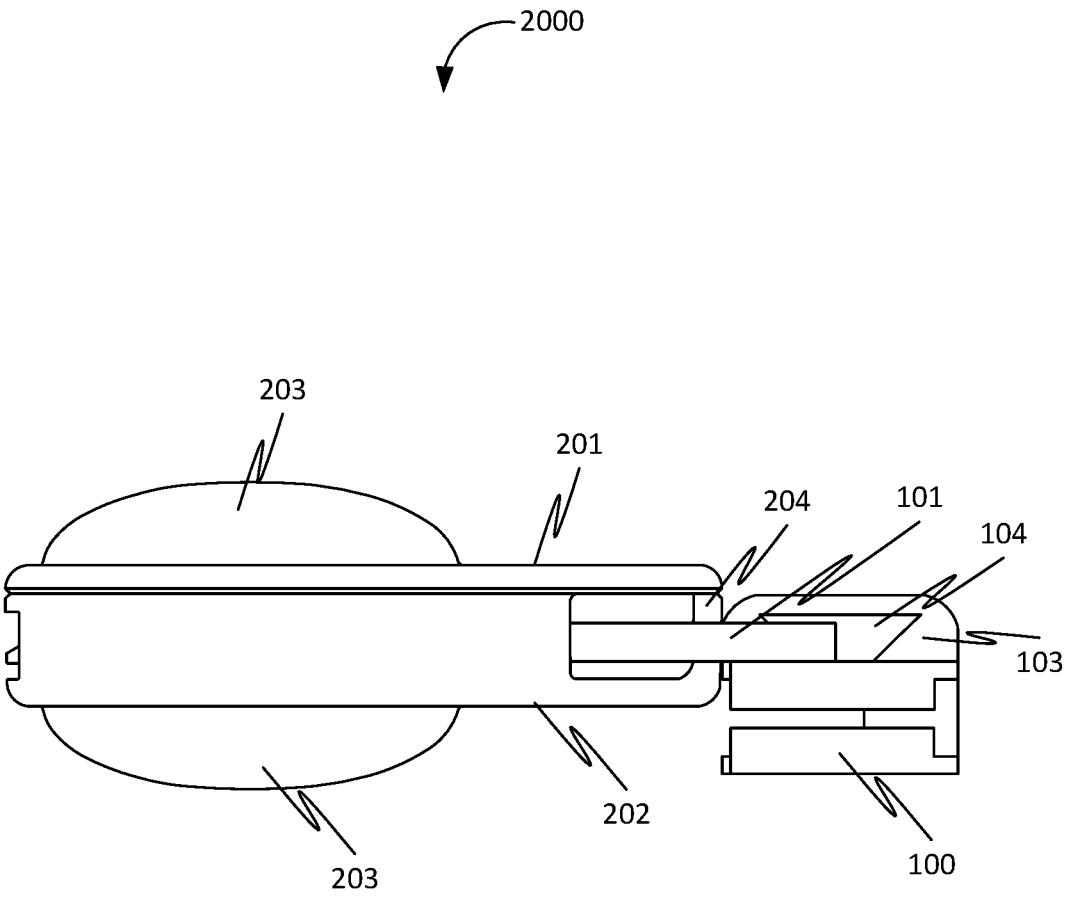
FIG. 23 is a right-side view of the zipper pull tab attachment 2000 when attached to the zipper pull tab 101, in accordance with some embodiments.

FIG. 23 is a right-side view of the zipper pull tab attachment 2000 when attached to the zipper pull tab 101, in accordance with some embodiments.

Figure 24:
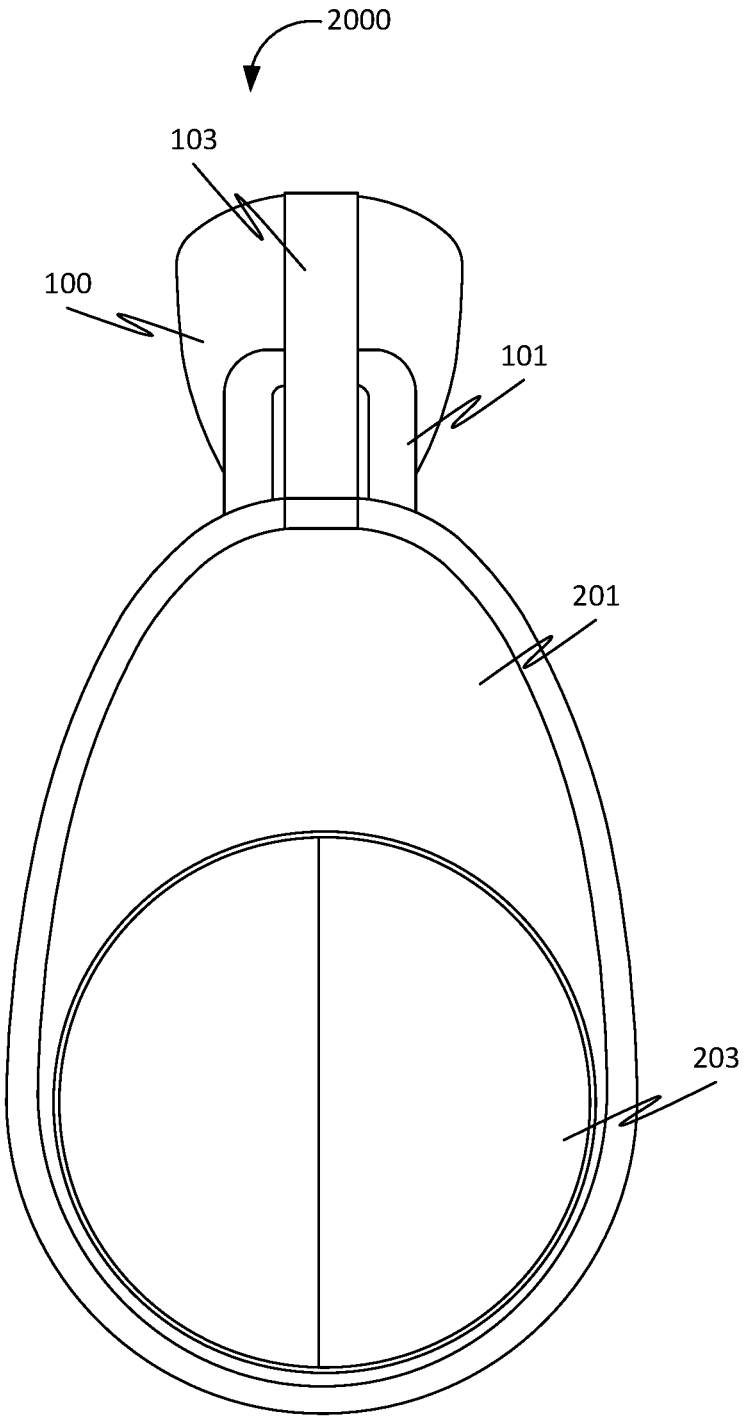
FIG. 24 is a top view of the zipper pull tab attachment 2000 attached to the zipper pull tab 101, in accordance with some embodiments.

FIG. 24 is a top view of the zipper pull tab attachment 2000 attached to the zipper pull tab 101, in accordance with some embodiments. As shown in FIG. 10, the top component 201 and the bottom component 202 may be connected using the hinges 209 along one side, and the magnetic closure 206 on the opposite side. Further, the zipper pull tab attachment 2000 may be attached to the zipper pull tab 101 by placing the bottom component 202 underneath the pull tab 101 with the extrusion 204 slid through the attachment hole 102. Further, a closure mechanism (comprising the hinges 209 and the magnetic closure 206) may be applied to secure the top component 201 and the bottom component 202 plates to each other and encase the pull tab 101, while the extrusion 204 secures the zipper pull tab attachment 2000 to the pull tab 101.

FIG. 25 is an exploded view of the top component 201 and the bottom component 202 of the zipper pull tab attachment 2000 attached to the zipper pull tab 101, in accordance with some embodiments.

FIG. 26 is an exploded view of the top component 201 and the bottom component 202 of the zipper pull tab attachment 2000 attached to the zipper pull tab 101, in accordance with some embodiments.

Figure 27:
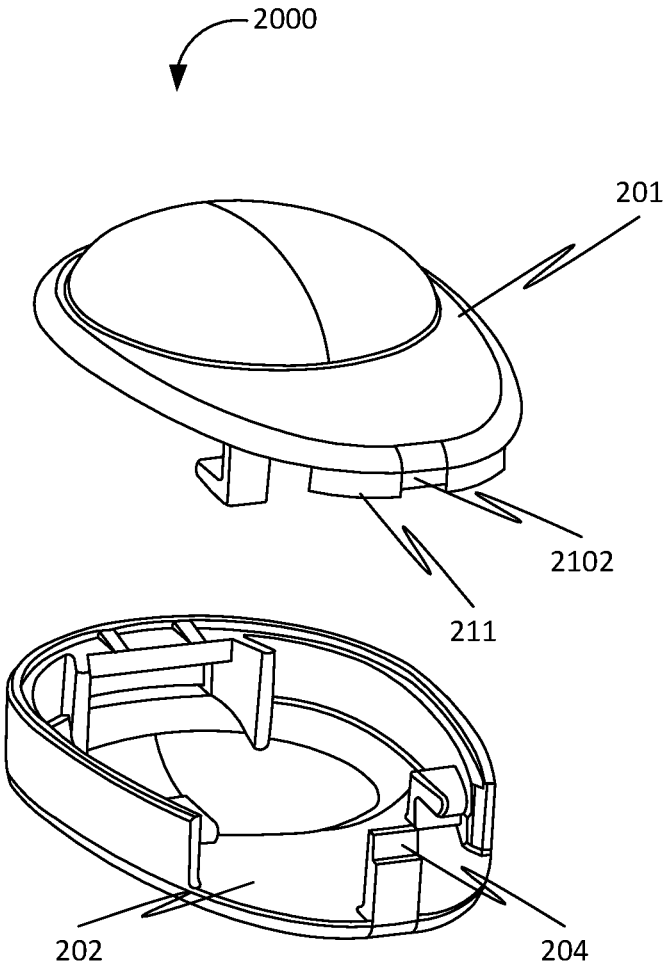
FIG. 27 is a first exploded view of the top component 201 and the bottom component 202 of the zipper pull tab attachment 2000, in accordance with some embodiments.

FIG. 27 is a first exploded view of the top component 201 and the bottom component 202 of the zipper pull tab attachment 2000, in accordance with some embodiments. Further, the top component 201 features a top barrier 211 to prevent the zipper pull tab 101 from potentially partially sliding up along the at least one protrusion 204 when attached. Further the top component 201 features a channel region 2102 to mate with the at least one protrusion 204.

More generally, in some embodiments of the zipper pull tab of attachment 2000, the top component 201 may include the top outer surface 1002 and the top inner surface 1004 opposing the top outer surface 1002. Further, the top component 201 may include the top barrier 211 disposed along at least a portion of periphery of the top component 201. Further, the portion may be proximal to the at least one top fastening component 205. Further, the top barrier 211 may include a contiguous wall disposed on the top inner surface 1004. Further, the contiguous wall may be characterized by a wall height. Further, a free-end of the contiguous wall may be configured to be in physical contact with an outer surface of the zipper pull tab 101 when the zipper pull tab attachment 2000 is attached to the zipper pull tab 101. Further, the top barrier 211 may be configured for preventing the zipper pull tab 101 from moving along a direction parallel to an axis corresponding to a length of the at least one protrusion 204. Further, the axis passes through the at least one opening 102.

Figure 28:
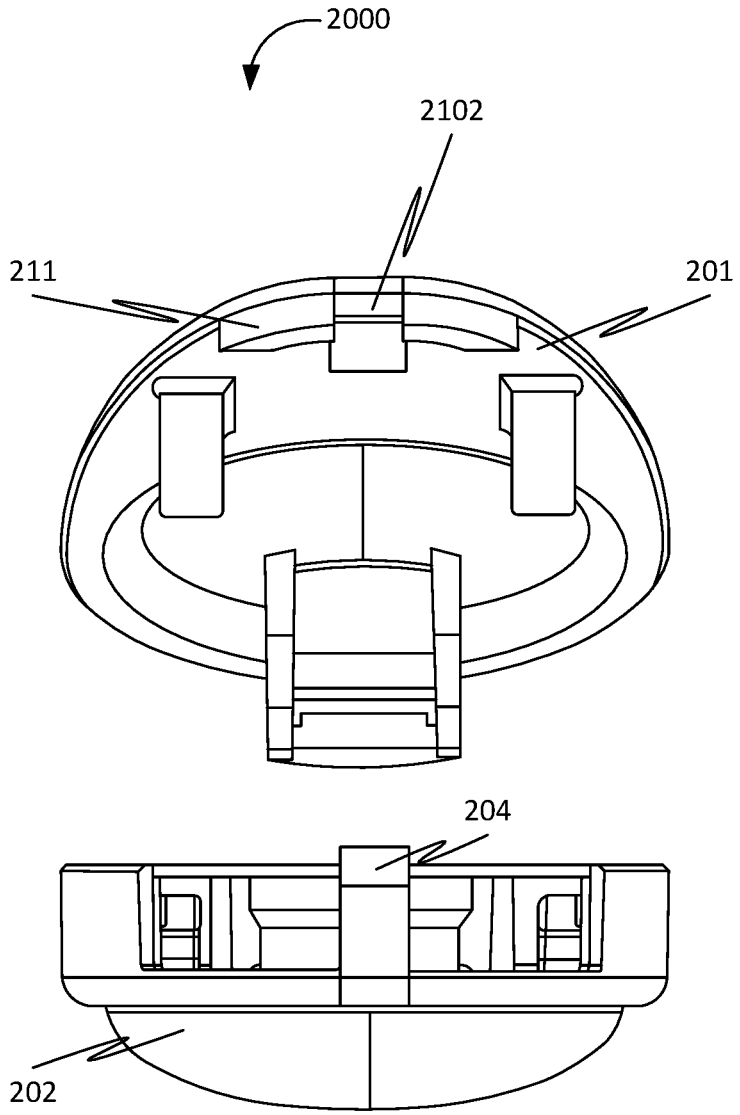
FIG. 28 is a second exploded view of the top component 201 and the bottom component 202 of the zipper pull tab attachment 2000, in accordance with some embodiments.

FIG. 28 is a second exploded view of the top component 201 and the bottom component 202 of the zipper pull tab attachment 2000, in accordance with some embodiments.

Figure 29:
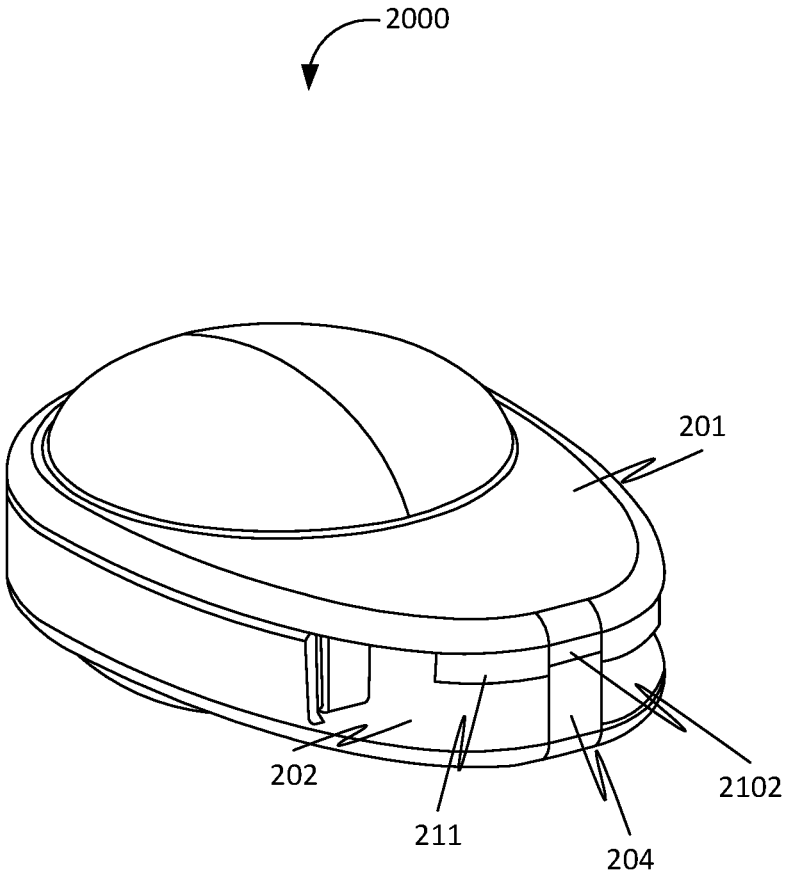
FIG. 29 is front top-right perspective view of the zipper pull tab attachment 2000, in accordance with some embodiments.

FIG. 29 is front top-right perspective view of the zipper pull tab attachment 2000, in accordance with some embodiments.

Figure 30:
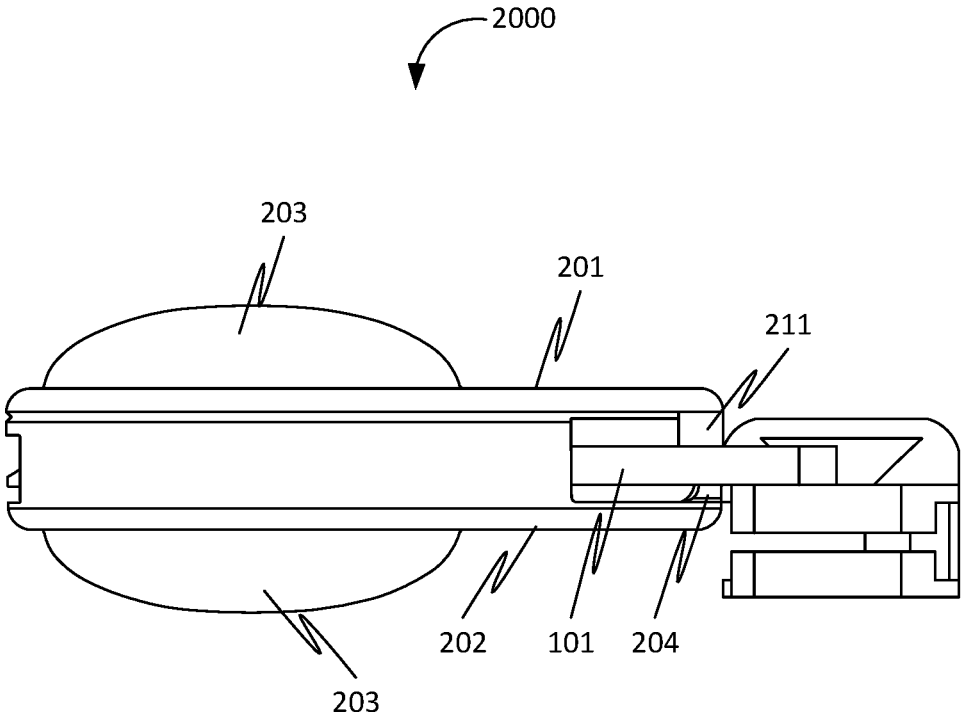
FIG. 30 is a right-side view of the zipper pull tab attachment 2000 attached to the zipper pull tab 101, in accordance with some embodiments.

FIG. 30 is a right-side view of the zipper pull tab attachment 2000 attached to the zipper pull tab 101, in accordance with some embodiments.

The foregoing description should not be considered to be restrictive. Further, features or variations may be provided in addition to those set forth herein. For example, embodiments may be directed to various feature combinations and subcombinations described in the detailed description.

Although the present disclosure has been explained in relation to its preferred embodiment, it is to be understood that many other possible modifications and variations can be made without departing from the spirit and scope of the disclosure.

What is claimed is:

1. A zipper pull tab attachment for providing an enlarged gripping surface to a zipper pull tab, wherein the zipper pull tab attachment comprises:

a top component comprising at least one top fastening component, wherein the top component further comprises a top outer surface and a top inner surface opposing the top outer surface, wherein the top outer surface is characterized by a top curvature, wherein the top curvature enlarges a gripping surface of the top outer surface; and a bottom component configured to be removably attached to at least a portion of the top component, wherein the top component and the bottom component form an interior space when attached together, wherein the interior space is configured for encasing at least a part of the zipper pull tab, wherein the bottom component comprises a bottom outer surface and a bottom inner surface opposing the bottom outer surface, wherein the bottom outer surface is characterized by a bottom curvature, wherein the bottom curvature enlarges a gripping surface of the bottom outer surface, wherein at least one of the bottom component and the top component further comprises a side barrier disposed along at least a portion of a periphery of at least one of the bottom component and the top component respectively, wherein the side barrier comprises a contiguous wall disposed on at least one of the bottom inner surface and the top inner surface respectively, wherein the contiguous wall is characterized by a wall height, wherein the side barrier is configured for preventing sliding out of the zipper pull tab from the interior space, wherein the bottom component further comprises:

at least one bottom fastening component, wherein the at least one top fastening component is configured to mate with the at least one bottom fastening component; and at least one protrusion, wherein the at least one protrusion is further configured to pass through at least one opening of the zipper pull tab.

2. The zipper pull tab attachment of claim 1, wherein the at least one top fastening component comprises a channel region, wherein the channel region is configured for mating with the at least one protrusion.

3. The zipper pull tab of attachment of claim 2, wherein the top component comprises:

a top outer surface and a top inner surface opposing the top outer surface;

a top barrier disposed along at least a portion of periphery of the top component, wherein the portion is proximal to the at least one top fastening component, wherein the top barrier comprises a contiguous wall disposed on the top inner surface, wherein the contiguous wall is characterized by a wall height, wherein a free-end of the contiguous wall is configured to be in physical contact with an outer surface of the zipper pull tab when the zipper pull tab attachment is attached to the zipper pull tab, wherein the top barrier is configured for preventing the zipper pull tab from moving along a direction parallel to an axis corresponding to a length of the at least one protrusion, wherein the axis passes through the at least one opening.

4. The zipper pull tab attachment of claim 1, wherein the at least one top fastening component comprises a male part of at least one snap-fit joint, wherein the at least one bottom fastening component comprises a female part of the at least one snap-fit joint.

5. The zipper pull tab attachment of claim 1 further comprises a hinge configured to attach at least a first portion of the top component with a second portion of the bottom component, wherein the hinge facilitates pivotal movement of the top component in relation to the bottom component.

6. The zipper pull tab attachment of claim 1, wherein the at least one opening comprises a proximal opening disposed on a proximal portion of the zipper pull tab, wherein the proximal portion is adjacent to a slider bridge of a zipper slider, wherein the at least one opening further comprises a distal opening disposed on a distal portion of the zipper pull tab, wherein the at least one protrusion comprises a proximal protrusion configured to pass through the proximal opening and a distal protrusion configured to pass through the distal opening.

7. The zipper pull tab attachment of claim 1, wherein the top component comprises a top outer surface and a top inner surface opposing the top outer surface, wherein the bottom component comprises a bottom outer surface and a bottom inner surface opposing the bottom outer surface, wherein at least one of the top outer surface and the bottom outer surface comprises at least one of grooves, textured coating and a soft-touch coating configured to enhance gripping of the zipper pull tab attachment with a finger.

8. A zipper pull tab attachment for providing an enlarged gripping surface to a zipper pull tab, wherein the zipper pull tab attachment comprises:

a top component comprising at least one top fastening component, wherein the at least one top fastening component comprises a channel region, wherein the channel region is configured for mating with at least one protrusion; and a bottom component configured to be removably attached to at least a portion of the top component, wherein the bottom component comprises a bottom outer surface and a bottom inner surface opposing the bottom outer surface, wherein the bottom outer surface is characterized by a bottom curvature, wherein the bottom curvature enlarges a gripping surface of the bottom outer surface, wherein the top component and the bottom component form an interior space when attached together, wherein the interior space is configured for encasing at least a part of the zipper pull tab, wherein the bottom component comprises:

at least one bottom fastening component, wherein the at least one top fastening component is configured to mate with the at least one bottom fastening component, wherein the at least one top fastening component comprises a male part of at least one snap-fit joint, wherein the at least one bottom fastening component comprises a female part of the at least one snap-fit joint; and the at least one protrusion, wherein the at least one protrusion is further configured to pass through at least one opening of the zipper pull tab, wherein the at least one opening comprises a proximal opening disposed on a proximal portion of the zipper pull tab, wherein the proximal portion is adjacent to a slider bridge of a zipper slider, wherein the at least one opening further comprises a distal opening disposed on a distal portion of the zipper pull tab, wherein the at least one protrusion is configured to pass through the proximal opening.

9. The zipper pull tab attachment of claim 8, wherein the top component comprises a top outer surface and a top inner surface opposing the top outer surface, wherein the top outer surface is characterized by a top curvature, wherein the top curvature enlarges a gripping surface of the top outer surface.

10. The zipper pull tab attachment of claim 9, wherein the bottom component further comprises a side barrier disposed along at least a portion of a periphery of the bottom component, wherein the side barrier comprises a contiguous wall disposed on the bottom inner surface, wherein the contiguous wall is characterized by a wall height, the side barrier is configured for preventing sliding out of the zipper pull tab from the interior space.

11. A zipper pull tab attachment for providing an enlarged gripping surface to a zipper pull tab, wherein the zipper pull tab attachment comprises:

a top component comprising at least one top fastening component, wherein the at least one top fastening component comprises a channel region, wherein the channel region is configured for mating with at least one protrusion; and a bottom component configured to be removably attached to at least a portion of the top component, wherein the bottom component comprises a bottom outer surface and a bottom inner surface opposing the bottom outer surface, wherein the bottom outer surface is characterized by a bottom curvature, wherein the bottom curvature enlarges a gripping surface of the bottom outer surface, wherein the top component comprises a top outer surface and a top inner surface opposing the top outer surface, wherein the top outer surface is characterized by a top curvature, wherein the top curvature enlarges a gripping surface of the top outer surface, wherein the top component and the bottom component form an interior space when attached together, wherein the interior space is configured for encasing at least a part of the zipper pull tab, wherein the bottom component comprises:

at least one bottom fastening component, wherein the at least one top fastening component is configured to mate with the at least one bottom fastening component, wherein the at least one top fastening component comprises a male part of at least one snap-fit joint, wherein the at least one bottom fastening component comprises a female part of the at least one snap-fit joint; and the at least one protrusion, wherein the at least one protrusion is further configured to pass through at least one opening of the zipper pull tab, wherein the at least one opening comprises a proximal opening disposed on a proximal portion of the zipper pull tab, wherein the proximal portion is adjacent to a slider bridge of a zipper slider, wherein the at least one opening further comprises a distal opening disposed on a distal portion of the zipper pull tab, wherein the at least one protrusion is configured to pass through the proximal opening.

12. The zipper pull tab attachment of claim 11 further comprising a hinge configured to attach at least a first portion of the top component with a second portion of the bottom component, wherein the hinge facilitates pivotal movement of the top component in relation to the bottom component.

* * * * *